US011918850B2

(12) United States Patent
Logan

(10) Patent No.: US 11,918,850 B2
(45) Date of Patent: Mar. 5, 2024

(54) STATIONARY EXERCISE BIKE FOR USE IN A CORRECTIONAL FACILITY

(71) Applicant: HLFIP Holding, Inc., Seminole, FL (US)

(72) Inventor: Jonathan D. Logan, Tampa, FL (US)

(73) Assignee: HLFIP Holding, Inc., Seminole, FL (US)

( * ) Notice: Subject to any disclaimer, the term of this patent is extended or adjusted under 35 U.S.C. 154(b) by 223 days.

(21) Appl. No.: 17/194,190

(22) Filed: Mar. 5, 2021

(65) Prior Publication Data

US 2021/0275863 A1 Sep. 9, 2021

Related U.S. Application Data

(60) Provisional application No. 62/985,835, filed on Mar. 5, 2020.

(51) Int. Cl.
*A63B 22/06* (2006.01)
*A63B 24/00* (2006.01)

(52) U.S. Cl.
CPC ..... *A63B 22/0605* (2013.01); *A63B 24/0062* (2013.01); *A63B 2220/34* (2013.01); *A63B 2220/50* (2013.01); *A63B 2220/62* (2013.01); *A63B 2220/801* (2013.01); *A63B 2230/06* (2013.01)

(58) Field of Classification Search
CPC ..... A63B 22/06; A63B 22/0605; A63B 21/00047; A63B 2230/06; A63B 22/0664; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; A63B 24/0062; A63B 2220/34; A63B 2220/50; A63B 2220/62; A63B 2220/801
See application file for complete search history.

(56) References Cited

U.S. PATENT DOCUMENTS 3,227,447 A * 1/1966 Baker ..... A63B 21/169 74/545
3,824,541 A * 7/1974 Nolan ..... B62H 5/20 340/432
5,312,312 A * 5/1994 Fernandez ..... A63B 21/169 482/904
6,152,861 A * 11/2000 Chen ..... A63B 22/0605 482/57
6,905,445 B1 * 6/2005 Lin ..... A63B 21/4049 188/24.11

(Continued)

*Primary Examiner* — Joshua Lee
(74) *Attorney, Agent, or Firm* — Outlier Patent Attorneys, PLLC

(57) ABSTRACT

A stationary exercise bike for use within a correctional facility is disclosed. The stationary bike having a frame portion, an adjustable seat portion, an adjustable handle portion, a drive mechanism, a display portion, and a housing portion comprising a locking system. In accordance with an embodiment, the housing portion encloses at least a portion of the frame portion, and cannot be opened unless the locking system is unlocked. The stationary exercise bike also comprises a retention portion for securely attaching at least a portion of frame portion to a wall or a floor.

11 Claims, 13 Drawing Sheets

(56) References Cited

U.S. PATENT DOCUMENTS

| | | | | |
|---|---|---|---|---|
| 10,022,590 | B2 * | 7/2018 | Foley | A63B 71/0622 |
| 2002/0193208 | A1 * | 12/2002 | Inoue | A63B 22/0605 482/57 |
| 2006/0105887 | A1 * | 5/2006 | Hao | A63B 22/0605 482/57 |
| 2009/0048076 | A1 * | 2/2009 | Irving | A63B 21/4034 482/57 |

* cited by examiner

STATIONARY EXERCISE BIKE FOR USE IN A CORRECTIONAL FACILITY

CROSS-REFERENCE TO RELATED APPLICATIONS

This application claims priority to U.S. Provisional Patent Application No. 62/985,835, filed Mar. 5, 2020 entitled "SYSTEMS AND METHODS FOR THE MANAGEMENT AND SYNDICATION OF ASSETS IN A CORRECTIONS FACILITY PLATFORM WITH AN EXERCISE APPARATUS." The entire content of that application is incorporated herein by reference.

BACKGROUND

Field of the Art

The invention relates generally to the field of exercise equipment and methods. In particular, the invention relates to a system and method for providing exercise in a controlled environment such as a correctional facility.

Discussion of the State of the Art

Exercise has proven to be extremely beneficial to almost all people. It may be particularly beneficial to individuals who are in a closed environment that restricts the activities that may be available and/or permissible to those who are a part of such an environment. For example, inmates or prisoners in a corrections facility may benefit tremendously from exercise. However, people in closed environments, particularly inmates, often are not motivated to exercise because exercise in a closed environment offers limited external motivation. For example, individuals in open societies may be motivated by being able to exercise to improve their quality of life. Inmates, on the other hand, may not be as motivated because they have limited ability to improve their quality of life in a prison system.

Moreover, traditional exercise equipment is often potentially dangerous and may not be suitable for closed/controlled environments such as corrections facilities. For example, dumbbells, barbells, treadmills, exercise bikes, etc. often have removable parts that may be used to injure or harm. Safer exercise equipment often does not provide enough feedback to keep users engaged and motivated.

As a result, exercise, and promotion of safe exercise, remains a difficult problem in closed/controlled environments such as prisons and/or corrections facilities.

SUMMARY

The present invention discloses systems and methods, as well as equipment, that may be used by users in a closed environment, such as a corrections facility. The apparatuses and systems described herein provide a safe exercise environment for users. Moreover, the systems and methods disclosed herein incentivize users to exercise by gamifying the process and by attaching real world rewards to exercises.

In one embodiment, an exercise bike is disclosed herein that may be secured against a floor or a wall to limit users' ability to move it. Moreover, in accordance with an embodiment, the exercise bike is enclosed in a housing that has a locking mechanism. A variety of various internal parts of the exercise bike are shrouded in the housing and may not be accessible unless the locking mechanism in unlocked. This feature of the present invention improves on safety aspects in a correctional facility by providing tight and secure control to corrections facility staff about portions of the exercise bike may be accessed and who may access them.

In addition, systems and methods disclosed herein incentivize users to exercise and exercise regularly by enabling users to earn rewards that may be unique to the closed environment that the exercise bike is placed within (such as a correctional facility). Generally, the systems and methods disclosed herein enable a user to earn benefits based on the effort they exert during an exercise session. This process generally motivates users to exercise and to exercise regularly. A variety of different benefits may be made available to the users based on the policies of the closed environment that the exercise bike is placed in. For example, a correctional facility, a user may earn benefits such as video visitation time, telephone time, messaging time, activity time, entertainment time, and physical rewards, etc. More specifically, the systems and methods disclosed herein enable a computing device receive exercise data (i.e. usage data), covert the usage data into exercise indicator data, and further convert the exercise indicator data into available benefits. The systems and methods disclosed herein enable the conversion process to be completed in real-time or near real time to further motivate the user to push through challenges and gamify the experience to make it more fun.

One benefit of the present invention is that exercise performance may be automatically recorded based on usage of exercise apparatuses. The recorded exercise performance may be automatically converted into an exercise indicator value, which may be used to acquire (e.g., redeem for, trade for, etc.) a benefit. The present invention automatically provides an incentive for exercise without the need of supervision from a third-party.

Additional benefits of the present invention include: improved physical and mental health, improved cardiovascular health, an outlet for stress relief, an opportunity to release pent up energy in a healthy and controlled way within a closed environment, a way to occupy time in a closed environment, the ability to teach individuals that work leads to rewards/benefits, incentivizing individuals to exercise, provide credits for free (or discounted) communication and entertainment in a closed environment, and providing a source of healthy competition.

In addition, the invention described herein may be integrated into a larger overall corrections facility technology and/or communications system which may share certain subcomponents of the present invention and allow for communication between components of the present invention and other components of the larger overall corrections facility system. Benefits of the overall system and the present invention include: ending inmate drug addiction, rehabilitating inmates, educating inmates, connecting inmates, transitioning inmates back into society, providing inmates with healthy forms of competition and outlets for physical exertion, mental health support, and ending the recidivism epidemic.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION

Figure 1:
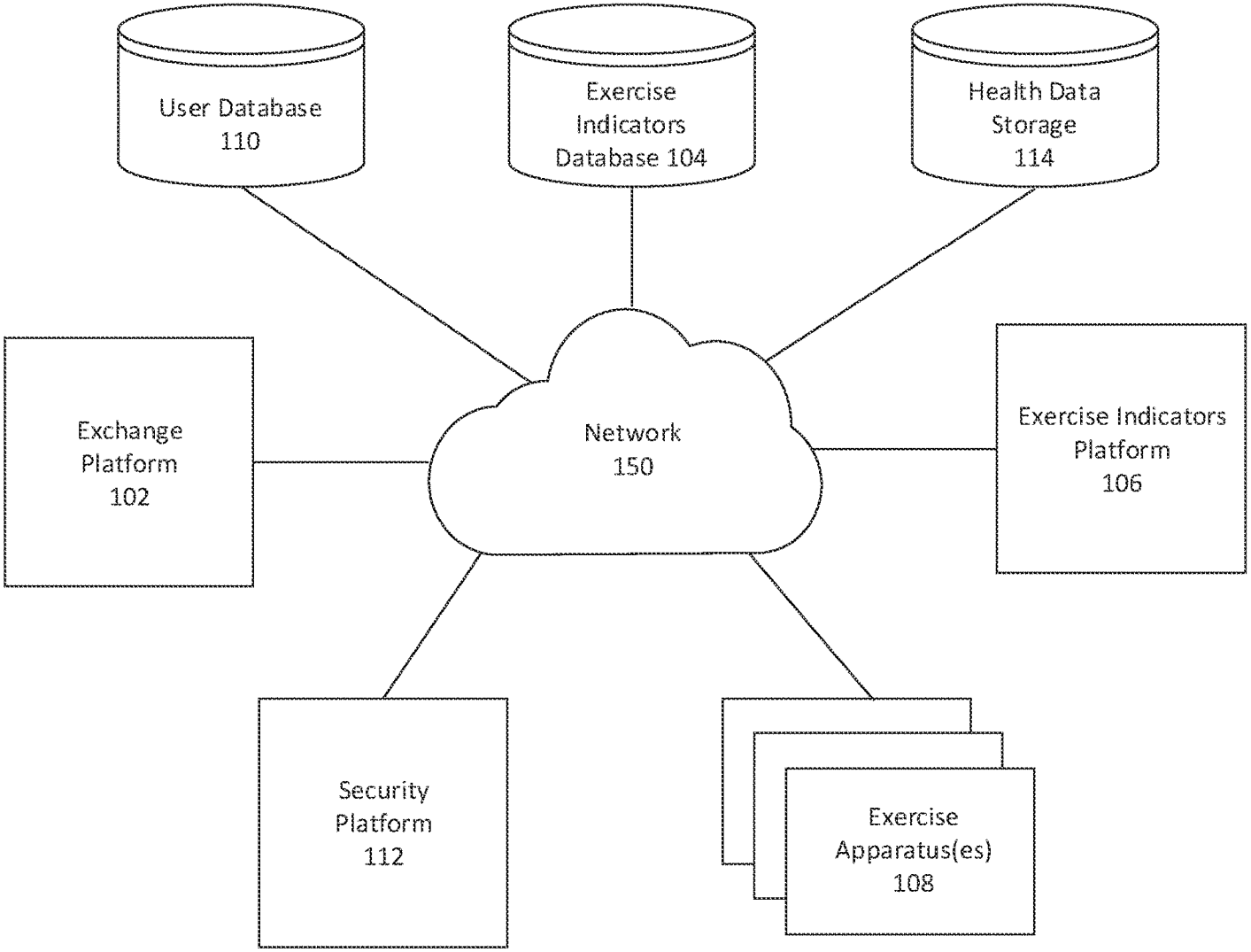
FIG. 1 illustrates an environment for rewarding exercise with an exemplary embodiment of the invention.

The inventive systems and methods (hereinafter sometimes referred to more simply as "system" or "method") described herein significantly reduce the effort it takes to incentivize a user to exercise. Specifically, the system collects usage data from an exercise apparatus and causes the usage data to be associated with a user profile. The usage data and/or the user profile may be used to determine session data. The session data may be used to determine exercise indicator data. The exercise indicator data may be used to acquire (e.g., purchase, buy, etc.) one or more benefits from the system. The one or more acquired benefits may incentivize and/or motivate a user to exercise.

In accordance with an embodiment, the present invention is comprised of a stationary exercise bike for use within a correctional facility, the exercise bike may comprise a frame portion that is configured to support a user to allow the user to at least one of sit and stand on the stationary exercise bike; an adjustable seat portion and an adjustable handle portion that are coupled to the frame; a drive mechanism that includes a pedal assembly and a flywheel, wherein the drive mechanism is capable of turning when a user applies force against at least a portion of pedal assembly; a display portion that is comprised of a tablet computing device, wherein the display portion is releasably attachable to the frame portion, the display portion electronically communicating with data received from sensors that are connected to the exercise bike, the display portion further capable of displaying exercise modules and performance related data; a housing portion comprising a locking system, wherein the housing portion encloses at least a portion of the frame portion, and wherein the housing portion cannot be opened unless the locking system is unlocked; and a retention portion for securely attaching at least a portion of the frame to at least one of flooring upon which the exercise bike is placed and a wall that may be disposed near the exercise bike. The exercise bike may further comprise at least one heart rate sensor that is disposed on the handle portion. In one embodiment, the tablet computing device of the display portion is in at least one of wired and wireless communication with at least one sensor. The exercise bike may also include a resistance adjustment mechanism for the rider to adjust the pedaling resistance of the bike. In one embodiment, the display portion may be configured to display at least one of the rider's identifier, the rider's cadence, resistance, heart rate and effort exerted while performing an exercise during an exercise module.

In accordance with an embodiment, the present invention is for an exercise system for use by inmates who are incarcerated within a correctional facility, the exercise system comprises an exercise device configured for a first inmate to cause movement of a portion of the exercise device, the first inmate having a first inmate identifier that is associated with the first inmate; a sensor operable to generate first inmate performance data based on activity by the first inmate when the first inmate causes movement of the portion of the exercise device; and a computer configured to: cause a display screen to present a plurality of exercise modules for selection; receive from the first inmate, via a user input interface, a selection of one of the plurality of exercise modules, thereby resulting in a selected exercise module; cause the display screen to display the content of the selected exercise module while the first inmate participates in the selected exercise module by causing movement of the portion of the exercise device; receive, via a sensor input interface, the first inmate performance data from the sensor during at least a portion of the selected exercise module; convert the received first inmate performance data into exercise indicators; and associate exercise indicators to the first inmate upon completion of the selected exercise module by associating, in a database, the exercise indicators to the first inmate identifier.

In one embodiment of the invention, the first inmate identifier may comprise of at least one of a username and identification code. The sensor may comprise of at least one of a voltage sensor, a current sensor, and a heart rate sensor. In one embodiment, the exercise modules comprise at least one of: live classes, pre-recorded classes, virtual cycling courses, and exercise routines.

In one embodiment of the invention, the exercise device comprises a stationary cycling device that enables the first inmate to pedal to cause movement of a portion of the exercise device.

In one embodiment, the first inmate performance data may comprise at least one of: voltage, current, pulses, time information, work, and power. The first inmate performance data may be used to determine at least one of: cadence, effort exerted, exercise duration, calories burned, heartrate, and speed information.

In one embodiment, the computer may be configured to cause the display screen to present a plurality of inmate benefit options for selection, said inmate benefit options associated with the exercise indicators, and receive from the first inmate, via the user input interface, a selection of at least one of the plurality of inmate benefit options.

In one embodiment, the value of an inmate benefit relative to an exercise indicator is based on a correctional facility clearinghouse. The inmate benefit options comprise an option to save exercise indicators for later use, wherein when the option to save exercise indicators for later use is received, the computer is further configured to save the exercise indicators in association with a user profile associated with the first inmate. In one embodiment, the inmate benefit options comprise at least one of video visitation time, telephone time, messaging time, activity time, entertainment time, and physical rewards. In one embodiment, the inmate benefit options comprise additional exercise modules. In one embodiment, receiving a selection of at least one of the inmate benefit options comprises combining exercise indicators from a plurality of exercise sessions.

The exercise system may also convert the received performance data into exercise indicators by allocating exercise indicators based on achieved predetermined performance thresholds associated with one or more exercise sessions. The predetermined performance thresholds comprise achieving a certain speed, maintaining a certain average speed, exercising for a certain duration, achieving a certain distance, maintaining a certain speed for a certain duration, calories burned and combinations thereof. The predetermined performance thresholds may comprise achieving certain multi-session goals including achieving weekly and/or monthly distance totals, calories burned totals, exercise duration totals and combinations thereof.

In one embodiment, the invention may comprise a computing device associated with an exercise apparatus that is located within a corrections facility, wherein the computing device is comprised of a memory store for storing exercise modules; a serving unit for serving exercise modules upon receiving a selection or a request; a display unit for displaying a selected or requested exercise module; and a processing unit configured to: cause a display screen to present a plurality of exercise modules for selection by a first inmate having a first inmate identifier that is associated with the first inmate; receive from the first inmate, via a user input interface, a selection of one of the plurality of exercise modules, thereby resulting in a selected exercise module; cause the display screen to display the content of the selected exercise module while the first inmate participates in the selected exercise module by causing movement of a portion of an exercise device; receive, via a sensor input interface, first inmate performance data from a sensor of the exercise device during at least a portion of the selected exercise module; convert the received performance data into exercise indicators; associate exercise indicators to the first inmate upon completion of the selected exercise module by associating, in a database, the exercise indicators to the first inmate identifier. In accordance with an embodiment of the invention, the processing unit is further configured to cause the display screen to present a plurality of inmate benefit options for selection, said inmate benefit options associated with the exercise indicators; and receive from the first inmate, via the user input interface, a selection of at least one of the plurality of inmate benefit options.

In one embodiment, the invention is also comprised of a method for serving exercise courses to an exercise apparatus at a corrections facility and computing performance of the users based on at least one performance parameter, the method comprising: receiving a selection of an exercise module; displaying the selected exercise module; receiving first inmate performance data associated with activity by a first inmate when the first inmate causes movement of a portion of an exercise device in association with the selected exercise module; converting the received first inmate performance data into exercise indicators; associating exercise indicators to the first inmate upon completion of the selected exercise module by associating, in a database, the exercise indicators with the first inmate identifier. The method may further comprise generating, by a processor, a first graphical user interface comprising historical user data; receiving, by a processor associated with an exercise device, digital content corresponding to an exercise module, the digital content comprising at least one segment; receiving, by the processor, performance data from a sensor of the exercise device, the performance data corresponding to activity of a user who is using the exercise device; converting, by the processor, the received performance data to exercise indicators; and generating, by the processor, a second graphical representation corresponding to a segment of the exercise module, a graphical representation corresponding to the received performance data, and a graphical representation corresponding to the converted exercise indicators.

One or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural, logical, software, electrical and other changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible embodiments and in order to more fully illustrate one or more embodiments. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, method, or algorithm is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various embodiments in which, for example, functions may be executed out of order from that shown or discussed, including substantially concurrently or in reverse order, depending on the functionality involved, as would be understood by those having ordinary skill in the art.

FIG. 1 illustrates a system for rewarding exercise with an exemplary embodiment of the invention. The system includes an exchange platform 102, an exercise indicators database 104, an exercise indicators platform 106, one or more exercise apparatus(es) 108, a user database 110, a security platform 112, a health data storage 114, and a network 150 over which various systems communicate and interact. The various computing devices described herein are exemplary and for illustration purposes only. The system may be reorganized or consolidated, as understood by a person of ordinary skill in the art, to perform the same tasks on one or more other servers or computing devices without departing from the scope of the invention.

The exchange platform 102 may comprise one or more software modules. The exchange platform 102 may reside on one or more computing devices. The exchange platform 102 may reside in a cloud computing environment. The exchange platform 102 may receive session data from the exercise indicators platform 106. The session data may comprise user profile information. The session data may also comprise usage data. The session data may be based on sensor data, wherein the sensor data may be one or more measurable attributes such as, but not limited to, voltage, current, pulses, time information, heart rate, effort exerted, or the like. Sensor data may be used to determine an amount of work performed or effort exerted during a session which may be used in additional calculations. For example, the session data may comprise how many calories a user with a particular user profile would be expected to burn while using an exercise apparatus 108, said calories burned being determined from the work performed or effort exerted. The exchange platform 102 may convert the received session data into exercise indicators. In one embodiment exercise indicators may take the form of points data and/or credit data. The exchange platform 102 may transmit the converted exercise indicators to the exercise indicators platform 106. In addition, the exercise apparatus(es) 108 may also receive control information from the exchange platform 102.

The exercise indicators database 104 may comprise a structured query language (SQL) format. The exercise indicators database 104 may comprise a Not only SQL (NoSQL) format. The exercise indicators database 104 may comprise a NewSQL format. The exercise indicators database 104 may reside in one or more centralized computing device(s). The exercise indicators database 104 may reside in a blockchain. The exercise indicators database 104 may store one or more user profiles. The exercise indicators database 104 may associate user profiles with exercise indicators. The exercise indicators platform 106 may retrieve exercise indicators associated with a user profile from the exercise indicators database 104.

The exercise indicators platform 106 may comprise one or more software modules. The exercise indicators platform 106 may reside on one or more computing devices. The exercise indicators platform 106 may reside in a cloud computing environment. The exercise indicators platform 106 may receive usage data from an exercise apparatus 108. The usage data may comprise sensor data which may be used to generate performance data in association with activity associated with use of an exercise apparatus 108. The usage data may comprise time information. The usage data may comprise user information. The exercise indicators platform 106 may use the user information to retrieve user profile data. The exercise indicators platform 106 may use the usage data and/or user profile data to create session data. Session data may comprise sensor data associated with a workout session associated with an exercise apparatus 108. Session data may comprise time data associated with a workout session associated with an exercise apparatus 108. Session data may be expressed as work performed or effort exerted and represent a workout session associated with an exercise apparatus 108. Session data may comprise calorie data associated with a workout session associated with an exercise apparatus 108. Session data may be expressed as calories burned and represent a workout session associated with an exercise apparatus 108.

The user database 110 stores user information such as user profiles and user information as discussed in more detail below. The health data storage 114 includes a HIPAA compliant data store for storage of protected health information (PHI). In addition, the health data storage 114 and network 150 may be configured for HIPAA compliant health data exchange with appropriate medical agencies and personnel.

The security platform 112 serves to protect an individual's user profile and usage data. The security platform 112 may require a user to login with a user ID and password in order to use the exercise apparatus(es) 108. The security platform 112 may use biometric authentication such as fingerprint recognition, face recognition, measuring a user's weight, or another unique characteristic of the user. The security platform 112 may use two-factor authentication such as a login and password in combination with biometric authentication.

The one or more exercise apparatus(es) 108 may comprise one or more of an exercise bicycle, a treadmill, an elliptical trainer, etc. The one or more exercise apparatus(es) 108 may comprise a heart rate monitor. The exercise apparatus(es) 108 may comprise one or more sensors operable to generate user performance data during use of the exercise apparatus. The sensors comprise comprises at least one of a voltage sensor, a current sensor, and a heart rate sensor. The one or more exercise apparatus(es) 108 may be designed to include various virtual experiences. For example, in the case of an exercise bike, there may be a variety of different cycling courses, classes, and exercise routines from which a user may choose. The one or more exercise apparatus(es) 108 may be designed to be fastened to a wall or floor. In addition, the one or more exercise apparatuses may be designed such that it has no removable parts and that all mechanical parts are completely covered and inaccessible by a user. The one or more exercise apparatus(es) 108 may be adjustable to accommodate different size users such as having an adjustable seat height/location or adjustable handlebar location. The one or more exercise apparatus(es) 108 may have adjustable resistance in the form of selectable preset resistance options, variable resistance options which can be controlled automatically and/or via manually adjustable resistance settings.

In the example where the one or more exercise apparatus(es) 108 is an exercise bike, the exercise bike may include integrated or connected digital hardware including at least one user input device including at least one display screen. The user input device will be described in more detail below. The exercise bike is also described in greater detail below in reference to FIG. 8. Generally, it may include a frame, a handlebar support connecting handlebars to the frame, and a seat support connecting a seat to the frame. Optionally the exercise bike may include a seat post which interfaces with the seat and seat support and a handlebar post which interfaces with the handlebars and handlebar support.

The exercise bike may include pedals to turn a wheel via a chain, belt or other drive mechanism. The wheel may be a heavy disc or other appropriate mechanism. The force on the pedals necessary to turn the wheel may be adjusted using a resistance adjustment mechanism which may be either mechanical in nature (e.g. a knob) or digital in nature (e.g. controlled via user input device or processor in accordance with an exercise program). The exercise bike may comprise one or more sensors operable to generate performance data based on activity associated with a user causing movement of pedals of the exercise bike.

The exercise bike may include various features to allow for adjusting the position of the seat, handlebars and user input/display screen. These various features may be designed such that while allowing for positional adjustment, removal of any component is prevented. For example, while the seat may be adjustable by sliding a seat post into/out of a seat support, the seat post and/or support are designed with a physical stop mechanism preventing the seat and seat post from being fully removed from the seat support. A similar design may be used for the handlebars/handlebar support and the connected digital hardware/user input device.

The frame may encase the wheel and associated drive mechanism such that these components are inaccessible by a user. In this instance, the frame may be of unitary construction such that it cannot be opened to access internal components of the exercise bike. In addition, the seat support and handlebar support may be integrated into the frame. The handlebars and handlebar post may be of unitary construction with no removable parts. Similarly, the seat and seat post may be of unitary construction with no removable parts. The exercise bike may be designed such that the only components accessible to a user include the pedals, the handlebars, the seat, and the user input/display.

The one or more exercise apparatus(es) may comprise a user input device. The user input device may allow a user to enter and/or access user information and/or user profile information. The user input device may provide a user interface through which a user may access previous exercise history, earned exercise indicators history, and the ability to select at least one of a plurality of exercise modules, such as via a touchscreen display. The user device may comprise a serving unit configured to cause a display (of the user device or separate display) to present a plurality of exercise modules for selection by a user and receive a selection of one of the exercise modules via a user input interface. The user input device may be integrated into one or more of the one or more exercise apparatus(es) 108, such as being mounted on, between, or above a set of handlebars. Alternatively, the user input/display device may be a separate component from the exercise apparatus(es) 108, such as tablet computer, which interfaces with the exercise apparatus(es) 108 via a wired or wireless connection. The user input device will be described in more detail below. The one or more exercise apparatus(es) 108 may generate sensor data during use. The one or more exercise apparatus(es) 108 may track a time of use. The one or more exercise apparatus(es) 108 may transmit usage data to the exercise indicators platform 106. The usage data may comprise monitored heart rate information, user information, user profile information, sensor data, time information, the like, and/or any combination of the foregoing.

The user device may also include an application that is loaded onto the user device. The application may receive data from a user and deliver the received data to the exercise indicators platform 106 via the network 150. The application may obtain data from the exercise indicators platform 106 via the network 150 and display the obtained data to the user within the application interface.

This disclosure contemplates any suitable number of user input devices, including computing systems taking any suitable physical form. As example and not by way of limitation, computing systems may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a tablet, a personal digital assistant (PDA), a server, or a combination of two or more of these. Where appropriate, the computing system may include one or more computer systems; be unitary or distributed; span multiple locations; span multiple machines; or reside in a cloud, which may include one or more cloud components in one or more networks. Where appropriate, one or more computing systems may perform without substantial spatial or temporal limitation one or more steps of one or more methods described or illustrated herein. As an example, and not by way of limitation, one or more computing systems may perform in real-time (e.g. as the data is generated and received by the computing systems) or in batch mode, one or more steps of one or more methods described or illustrated herein. One or more computing systems may perform at different times or at different locations one or more steps of one or more methods described or illustrated herein, where appropriate.

The network 150 generally represents a network or collection of networks (such as the Internet or a corporate intranet, or a combination of both) over which the various components illustrated in FIG. 1 (including other components that may be necessary to execute the system described herein, as would be readily understood to a person of ordinary skill in the art). In particular embodiments, network 150 is an intranet, an extranet, a virtual private network (VPN), a local area network (LAN), a wireless LAN (WLAN), a wide area network (WAN), a mesh network (wired or wireless), a metropolitan area network (MAN), a portion of the Internet, or another network 150 or a combination of two or more such networks 150. The network 150 connects the various systems, engines, platforms, databases and/or computing devices described or referenced herein. One or more links connect the systems, engines, platforms, databases and/or computing devices described herein to the network 150. In particular embodiments, one or more links each includes one or more wired, wireless, or optical links. In particular embodiments, one or more links each includes an intranet, an extranet, a VPN, a LAN, a WLAN, a WAN, a MAN, a portion of the Internet, or another link or a combination of two or more such links. The present disclosure contemplates any suitable network 150, and any suitable link for connecting the various systems and databases described herein. The network 150 may serve to share session data, exercise indicators data with approved personnel.

In particular embodiments, each system, platform, or engine may be a unitary server or may be a distributed server spanning multiple computers or multiple datacenters. Systems, engines, platforms, or modules may be of various types, such as, for example and without limitation, web server, news server, mail server, message server, advertising server, file server, application server, exchange server, database server, or proxy server. In particular embodiments, each system, engine, platform, or module may include hardware, software, or embedded logic components or a combination of two or more such components for carrying out the appropriate functionalities implemented or supported by their respective servers. For example, a web server is generally capable of hosting websites containing web pages or particular elements of web pages. More specifically, a web server may host HTML files or other file types, or may dynamically create or constitute files upon a request, and communicate them to clients devices or other devices in response to HTTP or other requests from clients devices or other devices. A mail server is generally capable of providing electronic mail services to various clients devices or other devices. A database server is generally capable of providing an interface for managing data stored in one or more data stores.

In particular embodiments, one or more data storages may be communicatively linked to one or more servers via one or more links. In particular embodiments, data storages may be used to store various types of information. In particular embodiments, the information stored in data storages may be organized according to specific data structures. In particular embodiment, each data storage may be a relational database. Particular embodiments may provide interfaces that enable servers or clients to manage, e.g., retrieve, modify, add, or delete, the information stored in data storage.

The system may also contain other subsystems and databases, which are not illustrated in FIG. 1, but would be readily apparent to a person of ordinary skill in the art. For example, the system may include databases for storing data, storing features, storing outcomes (training sets), and storing models. Other databases and systems may be added or subtracted, as would be readily understood by a person of ordinary skill in the art, without departing from the scope of the invention.

Figure 2:
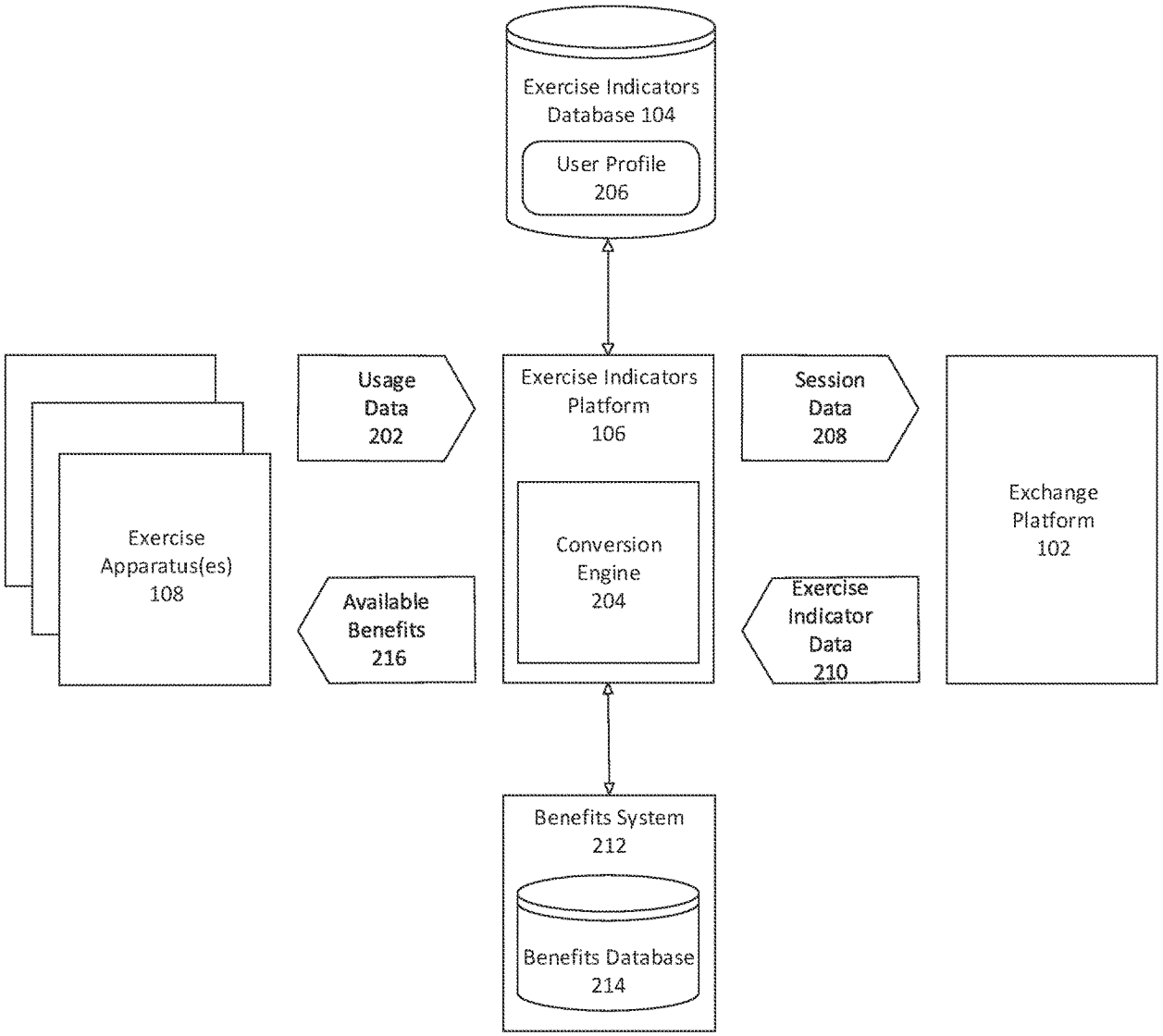
FIG. 2 illustrates data flow of a system for rewarding exercise in accordance with an embodiment of the invention.

FIG. 2 illustrates data flow of a system for rewarding exercise in accordance with an embodiment of the invention. The system comprises exercise apparatus(es), an exercise indicators platform, an exercise indicators database, an exchange platform, and a benefits system 212. Other systems and databases may be used, as would be readily understood by a person of ordinary skill in the art, without departing from the scope of the invention. In accordance with an embodiment of the invention, the system receives electronic usage data from the exercise apparatus 108 and—in real-time or near-real-time—converts that data into exercise indicator data, and further queries a benefits system and database to identify—in real-time or near real-time—the benefits that may be available to the user. In accordance with an embodiment of the invention, this analysis may be performed in increments of time that are small enough to appear to be real-time to a user and/or in a batch process after, for example, but not limited to a minute elapsed in the workout session.

One or more exercise apparatus(es) may transmit usage data 202 to the exercise indicators platform. The usage data may comprise monitored heart rate information, user information, user profile information, sensor data, time information, the like, and/or any combination of the foregoing.

The exercise indicators platform may comprise a conversion engine 204. The conversion engine 204 may convert usage data received from the one or more exercise apparatus(es) into session data 208. Session data 208 may comprise data associated with a workout session associated with one of the one or more exercise apparatus(es) 108. Session data 208 may comprise sensor data associated with a workout session associated with an exercise apparatus 108. Session data 208 may comprise time data associated with a workout session associated with an exercise apparatus 108. Session data 208 may be based on sensor data and represent a workout session associated with an exercise apparatus 108. Session data 208 may be based on work performed or effort exerted determined from sensor data associated with a workout session involving an exercise apparatus 108. For example, session data 208 may be expressed as calories burned and represent a workout session associated with an exercise apparatus 108.

The exercise indicators database may comprise one or more user profile(s) 206. The exercise indicators platform may use user information from the usage data 202 to retrieve a user profile 206 associated with the usage data 202 from the exercise indicators database 104. The exercise indicators platform may use the retrieved user profile 206 to create session data 208. For example, the exercise indicators platform may use a weight associated with the retrieved user profile 206 to determine a number of calories burned during a workout session associated with the usage data 202.

The exercise indicators platform may transmit the session data 208 to the exchange platform 102. The exchange platform 102 may convert the session data 208 into exercise indicator data 210. The exercise indicator data 210 may comprise a value representing the number of exercise indicators a user should receive based on an exercise session represented by the session data 208. In one embodiment, the exercise indicators may be in the form of points or credit data. For example, the exchange platform may convert one minute of session data 208 into two points or two credits. This is merely an example and conversion factors other than a 2:1 ratio may be used by the exchange platform 102 in converting session data 208 into exercise indicators data 210. The exchange platform 102 may transmit the exercise indicators data 210 to the exercise indicators platform 106.

In an aspect, the exercise indicators platform may use the exercise indicators data 210 received from the exchange platform 102 to determine real-time and/or near real-time exercise indicators acquired from a current session. In an aspect, the exercise indicators platform may retrieve exercise indicators associated with the user profile 206 from the exercise indicators database 104 to determine cumulative exercise indicators acquired. In an aspect, the exercise indicators platform may use the exercise indicators data 210 received from the exchange platform 102 and retrieve exercise indicators associated with the user profile 206 from the exercise indicators database 104 to determine cumulative point acquired in real-time or near real-time. In one embodiment, exercise indicators may be allocated and associated with a user profile upon completion of an exercise session such as completion of a selected exercise module.

The benefits system 212 may comprise a benefits database 214. The benefits system 212 may receive exercise indicators from the exercise indicators platform. The benefits systems 212 may use the received exercise indicators to query the benefits database 214 for available benefits 216. The benefits system 212 may return the available benefits 216 to the exercise indicators platform. The exercise indicators platform may transmit the available benefits 216 to the one or more of the one or more exercise apparatus(es) 108. The available benefits 216 may include at least: video visitation credits, telephone credits, messaging credits (e.g. with family/friends), activity time, entertainment credits (e.g. music, movies, games), physical/tangible rewards, or combinations thereof. In addition, the available benefits 216 may include unlocking new activities within the exercise apparatus(es) 108 such as new courses or activities or enabling other features within the exercise apparatus(es) 108. The value of an inmate benefit relative to an exercise indicator may be based on a correctional facility clearinghouse such that the value of exercise and provision of benefits to inmates can be conducted in an impartial manner and governed by an outside group without influence from correctional facility personnel. In one embodiment, the relative value may be constantly changing based on a variety of different factors described herein.

Additionally, the exercise indicators platform may be configured to cause the exercise apparatus 108 to present the user with an option to gain additional exercise indicators data 210. For example, a user may be prompted with an option allowing them to gain additional exercise indicators data 210 by achieving a certain max speed, by maintaining a certain average speed or revolutions per minute (rpm) over a given duration of time, by exceeding a minimum speed or rpm for a given duration of time, by achieving a certain distance in a given timeframe. This may comprise receiving performance data from an exercise session, comparing the performance data with predetermined thresholds for target achievements in order to determine if an achievement associated with bonus exercise indicators has been reached, and associating, within an exercise indicators database, the bonus exercise indicators with an inmate identifier. This may be done in real-time during the exercise session such that a user may be informed immediately upon obtaining an achievement of the additional exercise indicators gained. Alternatively, this may be done upon completion of an exercise session such that a user may be informed of any bonus exercise indicators earned at the conclusion of the exercise session.

In one embodiment, bonus exercise indicators may be given to inmates based on performance data indicating achievements over multiple exercise sessions. For example, bonus exercise indicators may be associated with an inmate identifier, in an exercise indicators database, for weekly and/or monthly performance goals such as achieving weekly and/or monthly mileage goals, weekly and/or monthly calories burned goals, percentage of days exercised in a week and/or month, number of consecutive days exercised, or the like. This may comprise storing historical user performance data in an exercise indicators database in association with an inmate identifier, updating the user performance data in the database whenever a new exercise session is completed, comparing the updated performance data with predetermined achievement thresholds in order to determine when an achievement associated with bonus exercise indicators has been reached, and associating, within an exercise indicators database, the bonus exercise indicators with an inmate identifier As another example of earning bonus exercise indicator data 210, a user may be prompted with an option allowing them to gain additional exercise indicators data 210 by answering questions during an exercise session. For example, a user may be presented with pop quizzes during an exercise session. This may comprise obtaining questions from a database, presenting the questions to the user via a display, obtaining user answers via a user input, storing user answers in database, determine if answers are correct by comparing stored user answers with stored correct answers, and allocating bonus exercise indicators for each correct answer, by associating, in an exercise indicators database, bonus exercise indicators with an inmate identifier.

Furthermore, the exercise indicators platform may notify the user via the exercise apparatus 108 of the need to maintain a certain minimum speed in order to earn exercise indicators data 210.

The exercise indicators platform may be configured to receive usage data 202 from the one or more exercise apparatuses 108 and use said usage data 202 to establish a live competition. The competition may be, for example, a race, a speed competition, a distance competition, a calories burned competition, or the like, or any combination thereof. The status of the competition may be displayed locally on each exercise apparatus 108 or globally (e.g. on a central display viewable by all users/spectators). The usage data 202 from the competition may be converted into session data 208 and used to reward exercise indicators 210 which may include additional (bonus) exercise indicators 210 based on the competition results.

In one embodiment, the exercise indicators platform may receive usage data 202 from a plurality of exercise apparatuses 108 in real-time and generate and update a scoreboard simultaneously thereby reflecting the status of a live competition such as a race, speed competition, distance competition or calories burned competition. The scoreboard may be presented locally on each exercise apparatus and/or globally at at least one display location separate from the exercise apparatuses such that the scoreboard is viewable by participants and spectators. In one embodiment, usage data for a plurality of exercise sessions may be stored in a database in association with an inmate identifier, the exercise indicators platform may receive historical usage data 202 from the database, analyze historical usage data to compute performance totals for a given period of time, and generate and update a scoreboard reflecting multi-session exercise competitions. For example, the received usage data for a plurality of exercise sessions may be used to generate a scoreboard reflecting week and/or month long competitions such as total distance cycled and/or total calories burned, over the competition duration. Performance in competitions may be used to assign bonus exercise indicators to inmates. For example, final ranking in the competition or by achieving a certain minimum threshold for the duration of the competition, may grant a user bonus exercise indicators for the competition which are assigned to the user by associating, within an exercise indicators database, bonus exercise indicators with an inmate identifier.

In addition, the exercise indicators platform may provide a user with temporary or permanent rewards within the exercise apparatus(es)/user interface based on usage data. For example, a badge system may be used to award a user with various badge type rewards for achieving various milestones such as miles ridden in a given timeframe (e.g. lifetime, per week or per month), max or average speed achieved over time, total calories burned, pounds of weight lost, total distance cycled, results of competition performances, etc. These badges may be displayed on a user profile page when they log in providing a sense of achievement and a source of motivation for exercise. Badges may also be shared with connected users such that users may be motivated by the performance of others or motivated to exercise in order to share their achievements with others. This may be accomplished by associating, within a database, two or more user identifiers, such as inmate identifiers, with each other thereby creating a network of connected users who can share exercise performances with one another.

Figure 3A:
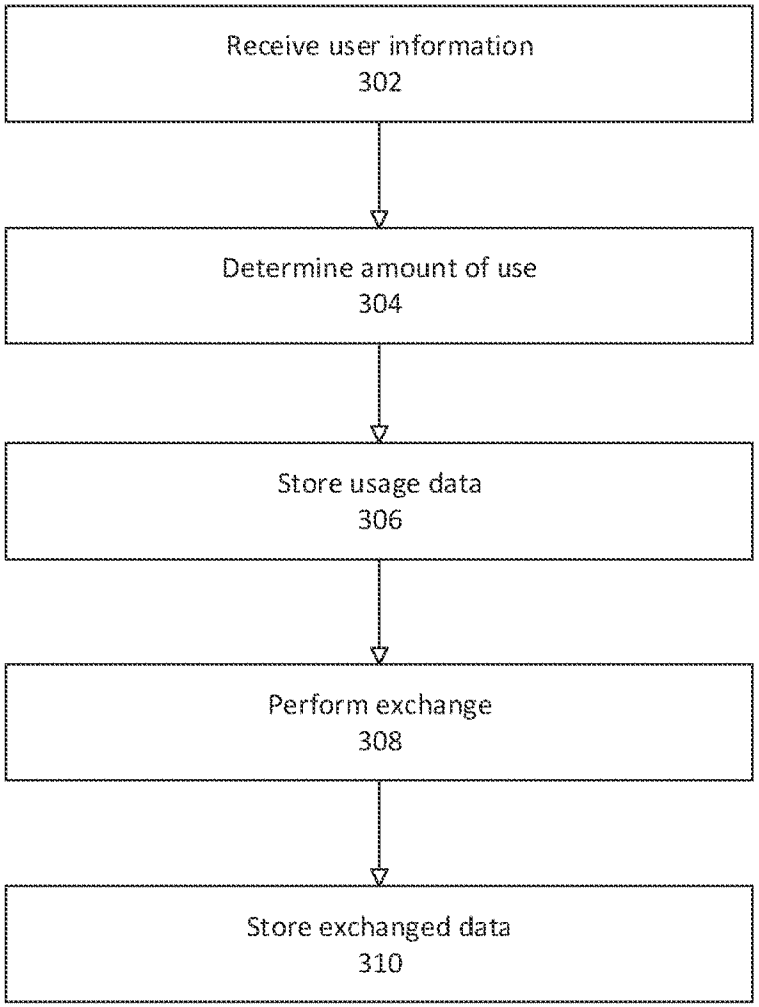
FIG. 3A illustrates a flowchart for rewarding exercise in accordance with an exemplary embodiment of the present invention.

FIG. 3A illustrates an exemplary process for allocating exercise indicators in accordance with an exemplary embodiment of the present invention.

At 302, user information may be received. For example, an exercise indicators platform may receive user information from one or more exercise apparatus(es). The user information may be used to populate (e.g., create, generate, etc.) a user profile. The user information may be used to retrieve (e.g., access, etc.) a user profile. The user information may comprise a unique identifier (e.g. user name, identification code, inmate identifier, etc.), a height, a weight, a body mass index (BMI), body fat percentage, historical performance data, the like and/or any combination of the foregoing. Other information may be received at this step comprising a user selection of an exercise module to be performed such as a virtual cycling course, a cycling class, or a cycling workout routine.

At 304, an amount of use, or usage data, may be determined. For example, an exercise indicators platform may determine an amount of use, or usage data, of the one or more exercise apparatus(es). The amount of use may be in the form of performance data from a sensor of an exercise apparatus, wherein the sensor generates performance data based on activity associated with a user causing movement of a portion of an exercise apparatus. The determined amount of use may be expressed as work performed or effort exerted which may be determined from sensor data. The determined amount of use may be expressed as calories. The determined amount of use may be associated with real-time use of an exercise apparatus. The determined amount of use may be associated with completion of use of an exercise apparatus.

At 306, the usage data may be archived. For example, an exercise indicators platform may store the usage data. As another example, an exercise indicators platform may archive the usage data in an exercise indicators database.

At 308, an exchange may be performed. The exchange may comprise converting usage data, such as performance data associated with a user causing movement of a portion of an exercise apparatus, into exercise indicators such as points or credits. In one embodiment, the exchange may be performed by applying a conversion factor thereby converting usage data into exercise indicators. A variety of different systems and/or methods may be used to identify a conversion factor. In one embodiment, the conversion factor may be variable and may vary based on a number of different factors. For example, the conversion factor may allow a user to convert usage data into additional exercise indictors based on other real-time factors, such as the number of users who may be using the exercise equipment at any given time, and/or user specific factors such as maintaining a certain speed and/or achieving a certain distance over a given time period.

At 310, the exchanged data may be archived. For example, an exercise indicators platform may store the exchanged data. As another example, an exercise indicators platform may archive the exchanged data in an exercise indicators database by associating, in a database, exercise indicators with a user identifier such as an inmate identifier. The exchanged data may be used to determine available benefits. In an embodiment, the available benefits may be delivered (e.g., transmitted, displayed, etc.) to the one of the one or more exercise apparatus(es) or exercise indicators may be archived for later use by the inmate. For example, a display may present a plurality of user benefit options for selection by a user. The user benefit options may comprise benefits available to a user based on accumulated exercise indicators and may also include an option to save accumulated exercise indicators for later use to acquire a benefit.

Figure 3B:
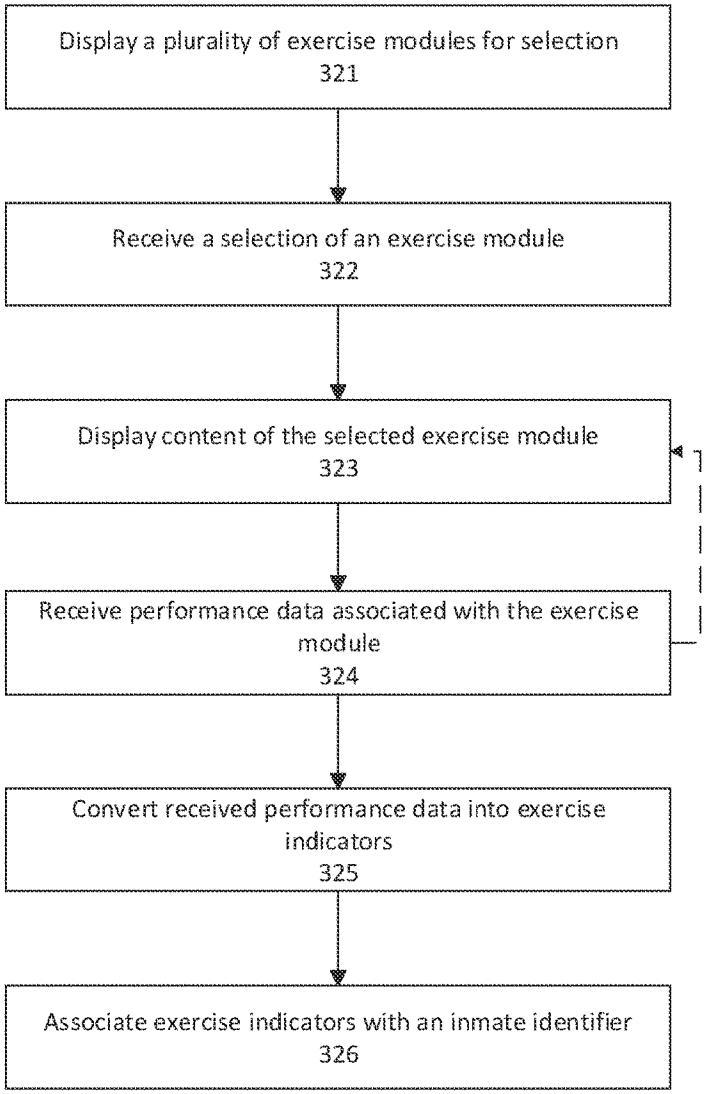
FIG. 3B illustrates a flowchart for rewarding exercise in accordance with an exemplary embodiment of the present invention.

FIG. 3B illustrates an exemplary process for allocating exercise indicators in accordance with an exemplary embodiment of the present invention. The process comprises displaying a plurality of exercise modules for selection 321, receiving a selection of an exercise module 322, displaying content of the selected exercise module 323, receiving performance data associated with the selected exercise module 324, converting the received performance data into exercise indicators 325, and associating exercise indicators with an inmate identifier 326.

At step 321, a plurality of exercise modules may be displayed for selection by a user of an exercise device. The exercise modules may comprise digital content such as live or pre-recorded exercise classes, virtual cycling courses, workout instructions, or the like. The plurality of exercise modules may be displayed on a display component of a user device associated with an exercise device such as a stationary exercise bike.

At step 322, a selection of an exercise module is received. The exercise module selection may be received via a user input interface. The user input interface may be associated with a user device associated with the exercise device.

At step 323, content of the selected exercise module is displayed. The content may comprise digital content displayed and updated in real-time as the user progresses through the exercise module and exercise session. In one aspect, the content may optionally be updated as a function of performance data received in step 324. For example, a first portion of an exercise module may require a user to cycle for a given distance or time before changing the content to a next portion of the exercise module and determining that the necessary distance or time has been reached may comprise receiving and analyzing performance data in order to determine which portion of the exercise module should be displayed.

At step 324, performance data associated with the selected exercise module is received. Performance data may comprise sensor data or be generated from sensor data in association with a user causing movement of a portion of an exercise device such as an exercise bike.

At step 325, received performance data is converted into exercise indicators. The performance data may be converted into exercise indicators using a conversion factor. The conversion factor may be fixed or variable. A variable conversion factor may be used to grant differing amounts of exercise indicators to a user during different portions of an exercise module or as a function of performance. For example, an exercise module may comprise portions where a user may be given bonus exercise indicators (e.g. double, triple, etc. a normal/base conversion rate) for performance data in a specified time frame of an exercise module. As another example, an exercise module may comprise portions where a user may earn incrementally increasing exercise indicators for maintaining a certain speed beyond a time threshold, such as 2 points per minute for maintaining a given speed for 2 minutes, 3 points per minute for maintaining a given speed for 3 minutes, etc.. These are merely exemplary and any conversion factor may be used in combination with any time threshold. Additionally, conversion factors may be a function of number of users such as during a competition wherein conversion factors are determined based on a user's ranking in the competition.

At step 326, the converted exercise indicators are associated with an inmate identifier. This may comprise associating, within a database, the converted exercise indicators with the inmate identifier.

Generally, the techniques disclosed herein may be implemented on hardware or a combination of software and hardware. For example, they may be implemented in an operating system kernel, in a separate user process, in a library package bound into network applications, on a specially constructed machine, on an application-specific integrated circuit (ASIC), or on a network interface card.

Software/hardware hybrid implementations of at least some of the embodiments disclosed herein may be implemented on a programmable network-resident machine (which should be understood to include intermittently connected network-aware machines) selectively activated or reconfigured by a computer program stored in memory. Such network devices may have multiple network interfaces that may be configured or designed to utilize different types of network communication protocols. A general architecture for some of these machines may be described herein in order to illustrate one or more exemplary means by which a given unit of functionality may be implemented. According to specific embodiments, at least some of the features or functionalities of the various embodiments disclosed herein may be implemented on one or more general-purpose computers associated with one or more networks, such as for example an end-user computer system, a client computer, a network server or other server system, a mobile computing device (e.g., tablet computing device, mobile phone, smartphone, laptop, or other appropriate computing device), a consumer electronic device, a music player, or any other suitable electronic device, router, switch, or other suitable device, or any combination thereof. In at least some embodiments, at least some of the features or functionalities of the various embodiments disclosed herein may be implemented in one or more virtualized computing environments (e.g., network computing clouds, virtual machines hosted on one or more physical computing machines, or other appropriate virtual environments).

Figure 4:
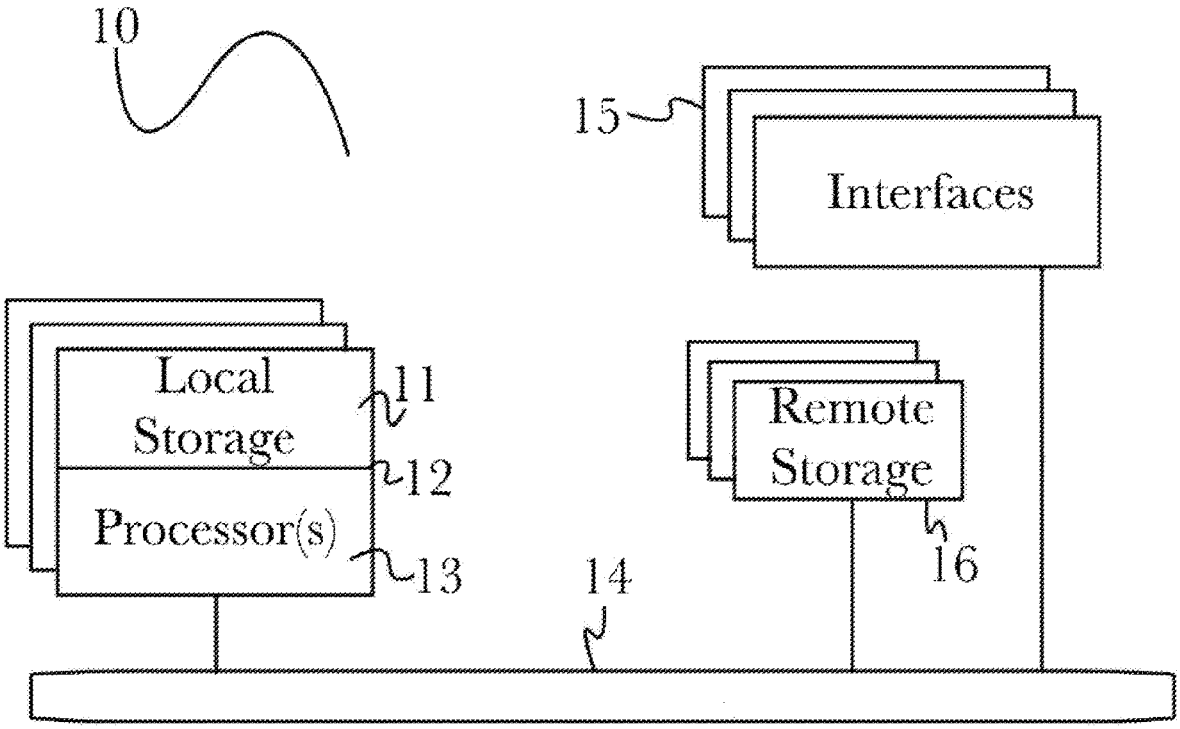
FIG. 4 illustrates an exemplary computing device that supports an embodiment of the inventive disclosure.

Referring now to FIG. 4, there is shown a block diagram depicting an exemplary computing device 10 suitable for implementing at least a portion of the features or functionalities disclosed herein. Computing device 10 may be, for example, any one of the computing machines listed in the previous paragraph, or indeed any other electronic device capable of executing software- or hardware-based instructions according to one or more programs stored in memory. Computing device 10 may be configured to communicate with a plurality of other computing devices, such as clients or servers, over communications networks such as a wide area network a metropolitan area network, a local area network, a wireless network, the Internet, or any other network, using known protocols for such communication, whether wireless or wired.

In one aspect, computing device 10 includes one or more central processing units (CPU) 12, one or more interfaces 15, and one or more busses 14 (such as a peripheral component interconnect (PCI) bus). When acting under the control of appropriate software or firmware, CPU 12 may be responsible for implementing specific functions associated with the functions of a specifically configured computing device or machine. For example, in at least one aspect, a computing device 10 may be configured or designed to function as a server system utilizing CPU 12, local memory 11 and/or remote memory 16, and interface(s) 15. In at least one aspect, CPU 12 may be caused to perform one or more of the different types of functions and/or operations under the control of software modules or components, which for example, may include an operating system and any appropriate applications software, drivers, and the like.

CPU 12 may include one or more processors 13 such as, for example, a processor from one of the Intel, ARM, Qualcomm, and AMD families of microprocessors. In some embodiments, processors 13 may include specially designed hardware such as application-specific integrated circuits (ASICs), electrically erasable programmable read-only memories (EEPROMs), field-programmable gate arrays (FPGAs), and so forth, for controlling operations of computing device 10. In a particular aspect, a local memory 11 (such as non-volatile random-access memory (RAM) and/or read-only memory (ROM), including for example one or more levels of cached memory) may also form part of CPU 12. However, there are many different ways in which memory may be coupled to system 10. Memory 11 may be used for a variety of purposes such as, for example, caching and/or storing data, programming instructions, and the like. It should be further appreciated that CPU 12 may be one of a variety of system-on-a-chip (SOC) type hardware that may include additional hardware such as memory or graphics processing chips, such as a QUALCOMM SNAPDRAGON™ or SAMSUNG EXYNOS™ CPU as are becoming increasingly common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In one aspect, interfaces 15 are provided as network interface cards (NICs). Generally, NICs control the sending and receiving of data packets over a computer network; other types of interfaces 15 may for example support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), Serial, Ethernet, FIREWIRE™, THUNDERBOLT™, PCI, parallel, radio frequency (RF), BLUETOOTH™, near-field communications (e.g., using near-field magnetics), 802.11 (WiFi), frame relay, TCP/IP, ISDN, fast Ethernet interfaces, Gigabit Ethernet interfaces, Serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, Point of Sale (POS) interfaces, fiber data distributed interfaces (FDDIs), and the like. Generally, such interfaces 15 may include physical ports appropriate for communication with appropriate media. In some cases, they may also include an independent processor (such as a dedicated audio or video processor, as is common in the art for high-fidelity A/V hardware interfaces) and, in some instances, volatile and/or non-volatile memory (e.g., RAM).

Although the system shown in FIG. 4 illustrates one specific architecture for a computing device 10 for implementing one or more of the embodiments described herein, it is by no means the only device architecture on which at least a portion of the features and techniques described herein may be implemented. For example, architectures having one or any number of processors 13 may be used, and such processors 13 may be present in a single device or distributed among any number of devices. In one aspect, single processor 13 handles communications as well as routing computations, while in other embodiments a separate dedicated communications processor may be provided. In various embodiments, different types of features or functionalities may be implemented in a system according to the aspect that includes a client device (such as a tablet device or smartphone running client software) and server systems (such as a server system described in more detail below).

Regardless of network device configuration, the system of an aspect may employ one or more memories or memory modules (such as, for example, remote memory block 16 and local memory 11) configured to store data, program instructions for the general-purpose network operations, or other information relating to the functionality of the embodiments described herein (or any combinations of the above). Program instructions may control execution of or comprise an operating system and/or one or more applications, for example. Memory 16 or memories 11, 16 may also be configured to store data structures, configuration data, encryption data, historical system operations information, or any other specific or generic non-program information described herein. The computing device 10 may be and/or comprise one or more of the above-mentioned exchange platform, exercise indicators database, and the exercise indicators platform.

Because such information and program instructions may be employed to implement one or more systems or methods described herein, at least some network device embodiments may include nontransitory machine-readable storage media, which, for example, may be configured or designed to store program instructions, state information, and the like for performing various operations described herein. Examples of such nontransitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include both object code, such as may be produced by a compiler, machine code, such as may be produced by an assembler or a linker, byte code, such as may be generated by for example a JAVA™ compiler and may be executed using a Java virtual machine or equivalent, or files containing higher level code that may be executed by the computer using an interpreter (for example, scripts written in Python, Perl, Ruby, Groovy, or any other scripting language).

Figure 5:
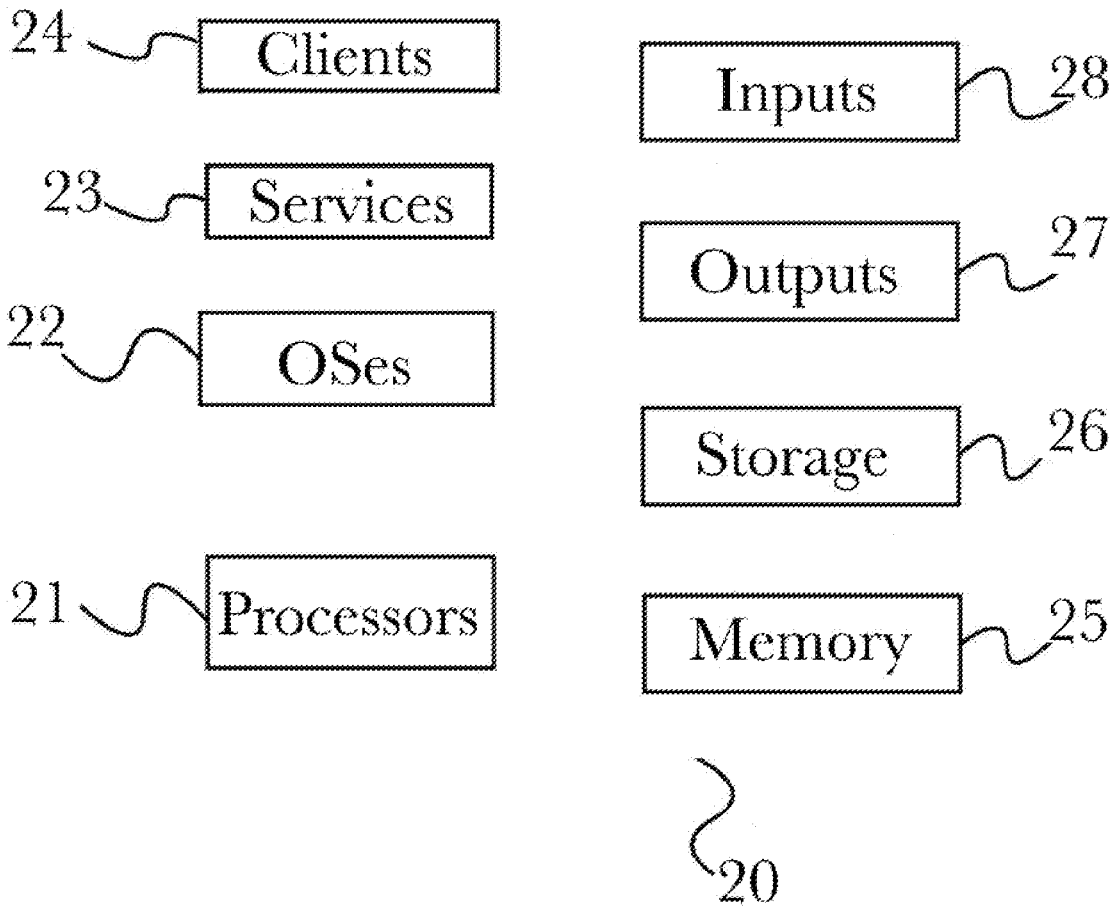
FIG. 5 illustrates an exemplary standalone computing system that supports an embodiment of the inventive disclosure.

In some embodiments, systems may be implemented on a standalone computing system. Referring now to FIG. 5 above, there is shown a block diagram depicting a typical exemplary architecture of one or more embodiments or components thereof on a standalone computing system. Computing device 20 includes processors 21 that may run software that carry out one or more functions or applications of embodiments, such as for example a client application 24. Processors 21 may carry out computing instructions under control of an operating system 22 such as, for example, a version of MICROSOFT WINDOWS™ operating system, APPLE macOS™ or iOS™ operating systems, some variety of the Linux operating system, ANDROID™ operating system, or the like. In many cases, one or more shared services 23 may be operable in system 20, and may be useful for providing common services to client applications 24. Services 23 may for example be WINDOWS™ services, user-space common services in a Linux environment, or any other type of common service architecture used with operating system 22. Input devices 28 may be of any type suitable for receiving user input, including for example a keyboard, touchscreen, microphone (for example, for voice input), mouse, touchpad, trackball, or any combination thereof. Output devices 27 may be of any type suitable for providing output to one or more users, whether remote or local to system 20, and may include for example one or more screens for visual output, speakers, printers, or any combination thereof. Memory 25 may be random-access memory having any structure and architecture known in the art, for use by processors 21, for example to run software. Storage devices 26 may be any magnetic, optical, mechanical, memristor, or electrical storage device for storage of data in digital form (such as those described above, referring to FIG. 5). Examples of storage devices 26 include flash memory, magnetic hard drive, CD-ROM, and/or the like.

The system 20 may be and/or comprise one or more of the exchange platform 102 in FIG. 1, the exercise indicators database 104 in FIG. 1, and the exercise indicators platform 106 in FIG. 1.

Figure 6:
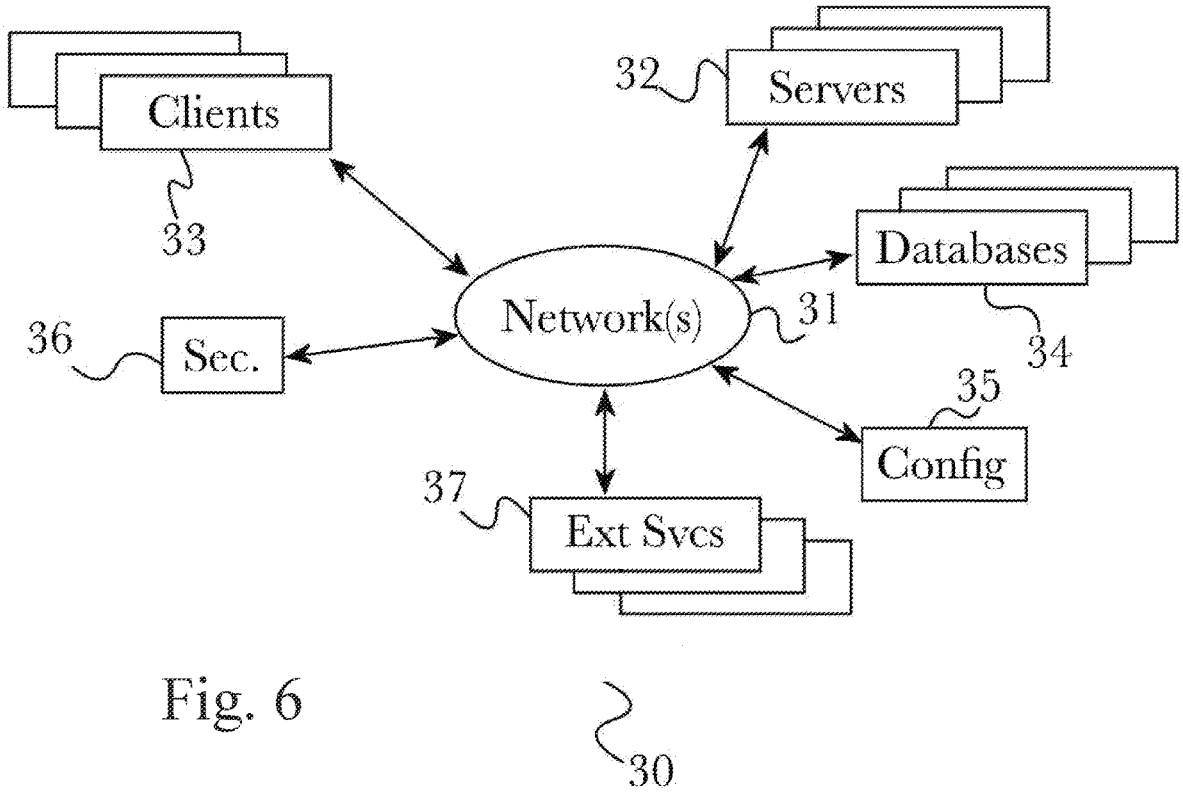
FIG. 6 illustrates one embodiment of the computing architecture that supports an embodiment of the inventive disclosure.

In some embodiments, systems may be implemented on a distributed computing network, such as one having any number of clients and/or servers. Referring now to FIG. 6, there is shown a block diagram depicting an exemplary architecture 30 for implementing at least a portion of a system according to one aspect on a distributed computing network. According to the aspect, any number of clients 33 may be provided. Each client 33 may run software for implementing client-side portions of a system; clients may comprise a system 20 such as that illustrated in FIG. 5. In addition, any number of servers 32 may be provided for handling requests received from one or more clients 33. Clients 33 and servers 32 may communicate with one another via one or more electronic networks 31, which may be in various embodiments any of the Internet, a wide area network, a mobile telephony network (such as CDMA or GSM cellular networks), a wireless network (such as WiFi, WiMAX, LTE, and so forth), or a local area network (or indeed any network topology known in the art; the aspect does not prefer any one network topology over any other). Networks 31 may be implemented using any known network protocols, including for example wired and/or wireless protocols.

In addition, in some embodiments, servers 32 may call external services 37 when needed to obtain additional information, or to refer to additional data concerning a particular call. Communications with external services 37 may take place, for example, via one or more networks 31. In various embodiments, external services 37 may comprise web-enabled services or functionality related to or installed on the hardware device itself. For example, in one aspect where client applications 24 are implemented on a smartphone or other electronic device, client applications 24 may obtain information stored in a server system 32 in the cloud or on an external service 37 deployed on one or more of a particular enterprise's or user's premises.

In some embodiments, clients 33 or servers 32 (or both) may make use of one or more specialized services or appliances that may be deployed locally or remotely across one or more networks 31. For example, one or more databases 34 may be used or referred to by one or more embodiments. It should be understood by one having ordinary skill in the art that databases 34 may be arranged in a wide variety of architectures and using a wide variety of data access and manipulation means. For example, in various embodiments one or more databases 34 may comprise a relational database system using a structured query language (SQL), while others may comprise an alternative data storage technology such as those referred to in the art as "NoSQL" (for example, HADOOP CASSANDRA™, GOOGLE BIGTABLE™, and so forth). In some embodiments, variant database architectures such as column-oriented databases, in-memory databases, clustered databases, distributed databases, or even flat file data repositories may be used according to the aspect. It will be appreciated by one having ordinary skill in the art that any combination of known or future database technologies may be used as appropriate, unless a specific database technology or a specific arrangement of components is specified for a particular aspect described herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, some embodiments may make use of one or more security systems 36 and configuration systems 35. Security and configuration management are common information technology (IT) and web functions, and some amount of each are generally associated with any IT or web systems. It should be understood by one having ordinary skill in the art that any configuration or security subsystems known in the art now or in the future may be used in conjunction with embodiments without limitation, unless a specific security 36 or configuration system 35 or approach is specifically required by the description of any specific aspect.

The one or more of the server(s) 32 may be and/or comprise one or more of the exchange platform 102 in FIG. 1, the exercise indicators database 104 in FIG. 1, and the exercise indicators platform 106 in FIG. 1.

Figure 7:
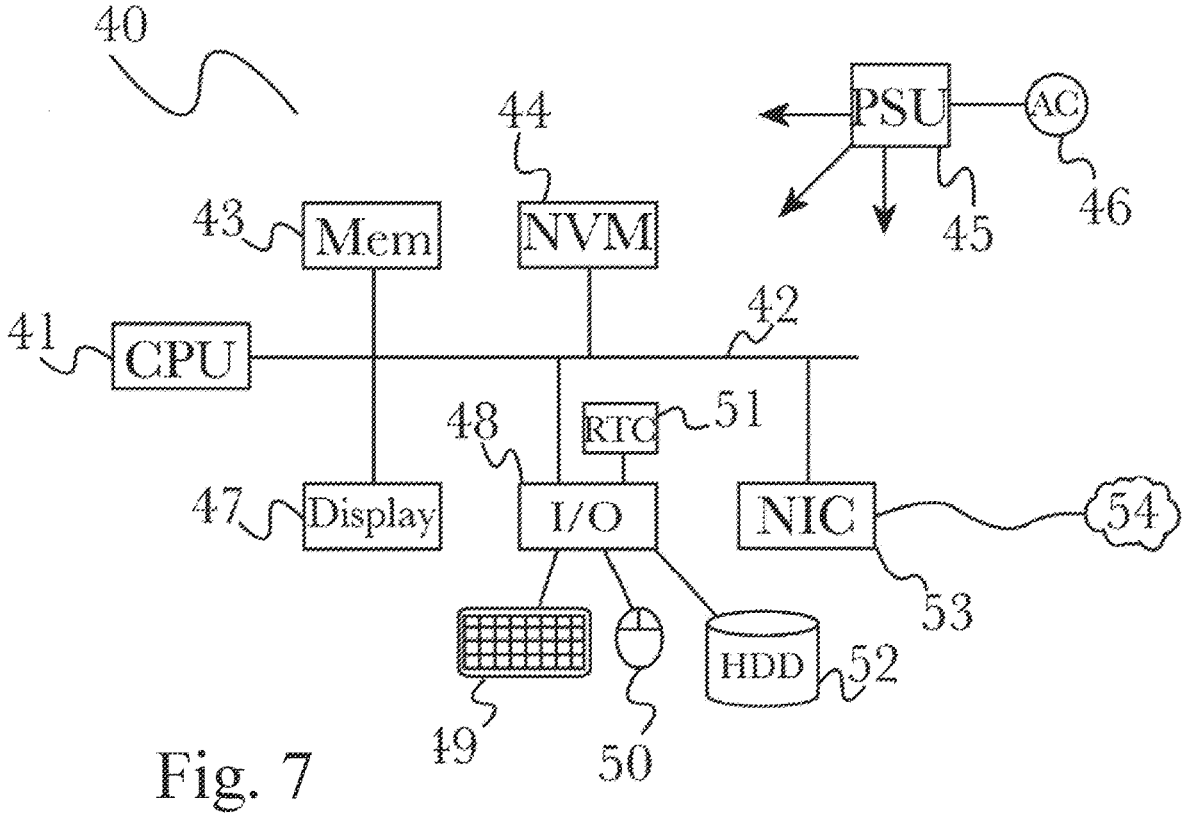
FIG. 7 illustrates an exemplary overview of a computer system that supports an embodiment of the inventive disclosure.

FIG. 7 shows an exemplary overview of a computer system 40 as may be used in any of the various locations throughout the system. It is exemplary of any computer that may execute code to process data. Various modifications and changes may be made to computer system 40 without departing from the broader scope of the system and method disclosed herein. Central processor unit (CPU) 41 is connected to bus 42, to which bus is also connected memory 43, nonvolatile memory 44, display 47, input/output (I/O) unit 48, and network interface card (NIC) 53. I/O unit 48 may, typically, be connected to keyboard 49, pointing device 50, hard disk 52, and real-time clock 51. NIC 53 connects to network 54, which may be the Internet or a local network, which local network may or may not have connections to the Internet. Also shown as part of system 40 is power supply unit 45 connected, in this example, to a main alternating current (AC) supply 46. The computing system 40 may include an I/O interface 56 for connecting to the exercise apparatus(es) 108. Not shown are batteries that could be present, and many other devices and modifications that are well known but are not applicable to the specific novel functions of the current system and method disclosed herein. It should be appreciated that some or all components illustrated may be combined, such as in various integrated applications, for example Qualcomm or Samsung system-on-a-chip (SOC) devices, or whenever it may be appropriate to combine multiple capabilities or functions into a single hardware device (for instance, in mobile devices such as smartphones, video game consoles, in-vehicle computer systems such as navigation or multimedia systems in automobiles, or other integrated hardware devices). The computer system 40 may be and/or comprise one or more of the above-mentioned exchange platform, exercise indicators database, and exercise indicators platform.

In various embodiments, functionality for implementing systems or methods of various embodiments may be distributed among any number of client and/or server components. For example, various software modules may be implemented for performing various functions in connection with the system of any particular aspect, and such modules may be variously implemented to run on server and/or client components.

Figure 8A:
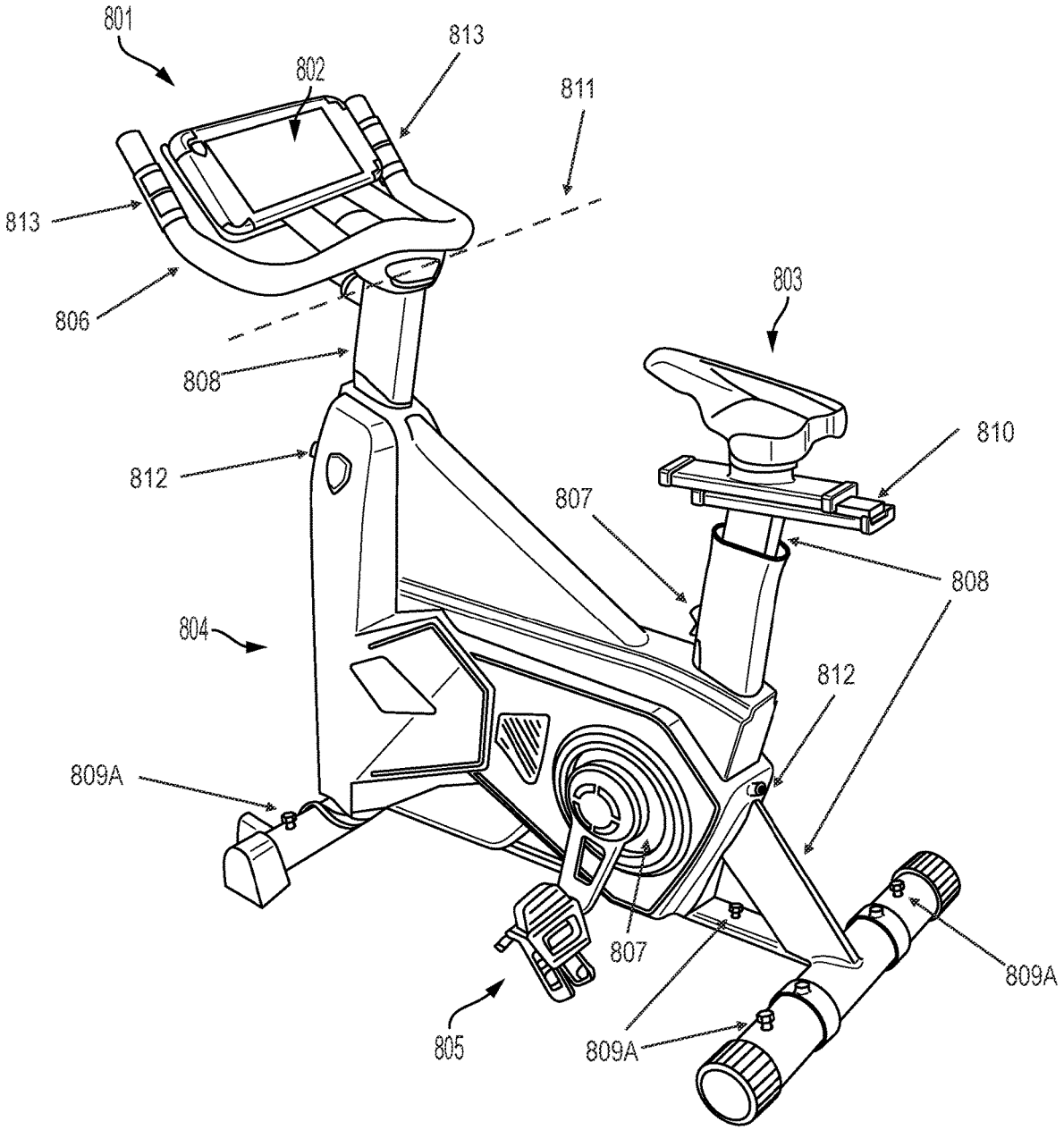
FIG. 8A illustrates an exemplary exercise apparatus in accordance with the present invention.
Figure 8B:
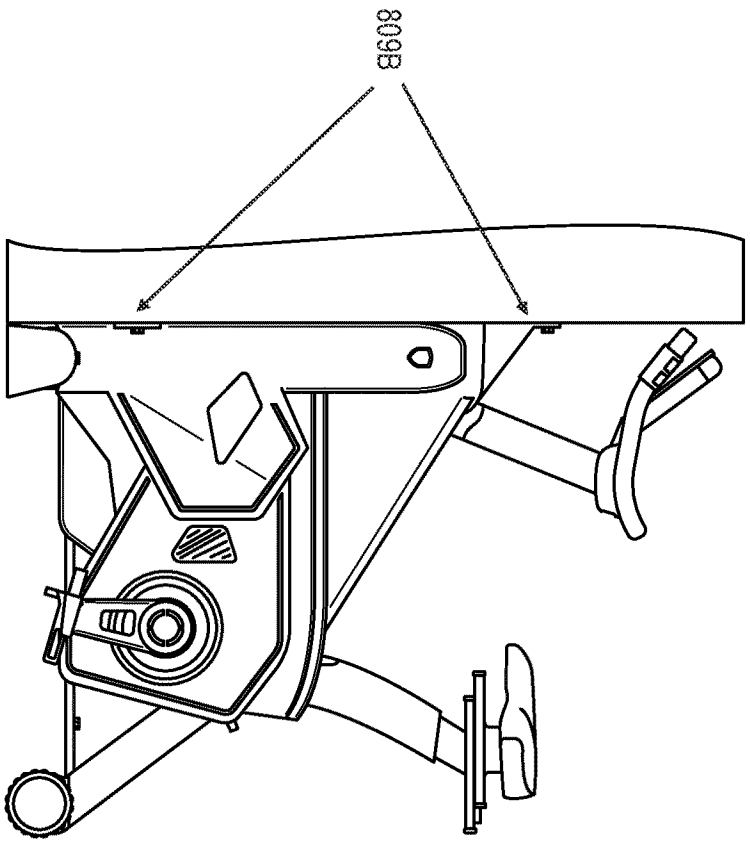
FIG. 8B illustrates an exemplary exercise apparatus in accordance with the present invention.
Figure 8C:
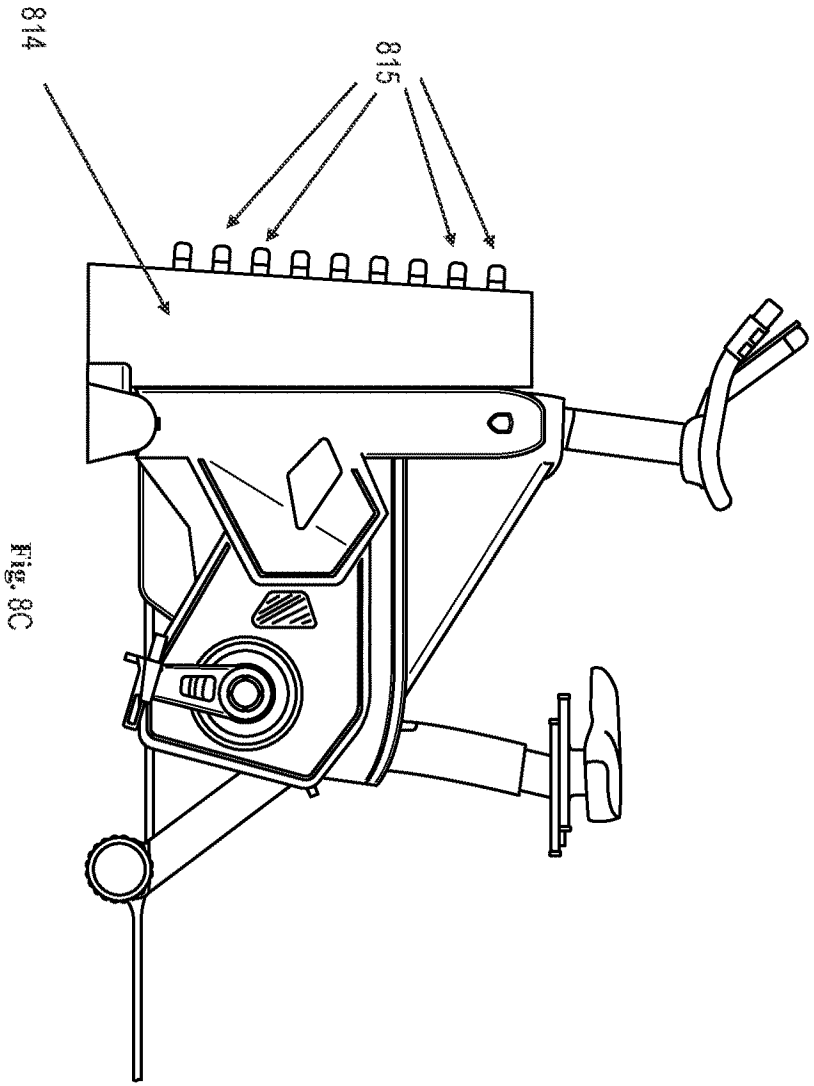
FIG. 8C illustrates an exemplary exercise apparatus in accordance with the present invention.

FIGS. 8A-C illustrate an exemplary exercise apparatus 801 (herein also referred to as a stationary exercise bike, stationary bike, exercise bike, etc.) associated with an embodiment of the inventions disclosed herein. As illustrated in FIG. 8A, the stationary bike has an open geometry that allows a rider to simulate different riding positions and conditions. It is comprised of a display portion 802, an adjustable seat portion 803, a housing portion 804, a pedal assembly 805, an adjustable handle portion 806, a variable resistance mechanism 807, a frame portion 808, and a retention system 809A, 809B.

In one embodiment, the display portion 802 is fully integrated into the stationary bike 801 and may not be removable without using specialized tools and/or without removing a lock associated with the housing portion 804, which is described in greater detail below. For example, the display portion may be bolted onto a framing that is enclosed by the housing portion 804. This feature of the invention prevents users or anyone from removing the display portion 802 and prevents tampering with the display or any portion thereof.

In one embodiment, the display portion 802 may be comprised of a computing device, such as, but not limited to, a tablet computing device. The tablet computing device may communicatively attach to the stationary bike 801 to enable the operation of the device as described herein. In one embodiment, the tablet computing device may be the same device that a user may access and/or review email communication or digitized postal mail communication that may be sent to a user's postal mail account. In one embodiment, the stationary bike 801 may include a tablet storage component 814 attached to the front of the housing portion 804 and configured to store a plurality of tablet computing devices 815 each comprising a display portion 802.

In one embodiment, the display portion 802 may be comprised of a touch enabled screen that displays selectable exercise modules, receives input from a user such as selection of an exercise module, presents digital content of the exercise modules during exercise, and presents information associated with exercise performance and exercise indicators acquired in association with causing movement of pedals 805. The user interface elements that may be displayed on the display portion are illustrated in greater detail in reference to FIGS. 9, 10, and 11.

A computer or other storage device (illustrated in FIGS. 4-7) is optionally contained within display portion 802. However, the computer or other storage device may be remotely located. The computer preferably stores riding instructions and/or virtual courses that are conveyed to the rider through display portion 802. The computer may also receive instructions and/or data from the user through an input device contained within the display 802 so that the instructions provided during the ride may be customized per the rider's specifications. Moreover, the display portion 802 may also illustrate other aspects of the invention, including, a leaderboard, the position of other users within the same course during when a particular amount of time has elapsed, etc., as further described in the specification and in reference to FIGS. 9, 10, and 11.

In an embodiment, the display portion 802 may also include a speaker (not illustrated). The speaker may be connected to a computer, a stereo, a video monitor, or other type of multi media device. The speaker may be used to enable riders to hear audible beeps indicating a change in position is needed. The speaker may also enable the rider to listen to instructions or information as well as various entertainment media such as music.

The adjustable seat portion 803 and the adjustable handle portion 806 enable a user to adjust the stationary bike 801 to desired preferences. Various pop-pins (or other suitable mechanism) may be used to effect up/down and fore/aft adjustment of seat portion 803, and up/down adjustment of handle portion 806. It is preferred that the seat and handlebar be adjusted to safely accommodate different riding positions such as sitting and standing, different hand positions, as well as users of various sizes. More specifically, the seat portion 803 may be movable in a fore/aft direction by sliding the seat portion 803 along a track 810. The seat portion may be tilted upward or downward based on interior loaded spring mechanism (not illustrated). Similarly, the handle portion 806 may be rotatable along a central axis 811 to enable adjustments.

The housing portion 804 encloses the frame portion 808 as well as the variable resistance mechanism 807 and their connecting components. In one embodiment, the housing portion 804 is further comprised of a locking mechanism 812 that enables an administrator or an individual with the requisite access to lock the housing portion 804. Once locked, users or individuals would not be able to open the housing portion 804 and would not be able to access any of the mechanical components that are encased within the housing portion 804. FIG. 8A illustrates an exemplary embodiment wherein the mechanical components of the stationary bike 801 are enclosed by the housing portion 804. In the embodiment illustrated in FIG. 8, some portions of the framing (such as the portion below the handle bar) may be exposed and may be outside of the housing portion 804. However, in other embodiments, all portions of the user device, except for the handle portion 806, seat portion 803, display portion 802, and pedals 805 (and the extension portions that connect the pedals 805 to the variable resistance mechanism 807) are enclosed within the housing portion 804.

A variety of different locking mechanisms 812 may be used to enclose the housing portion 804, as would be apparent to a person of ordinary skill in the art, without departing from the scope of the invention. For example, and not limited to, a lock and key system may be used, a combination lock system may be used, a biometric authentication lock system, etc. may be used to prevent unauthorized individuals from accessing the contents that are enclosed within the housing portion 804.

The pedal assembly 805 may include a flywheel, which are integrally connected (they may, however, be connected in a variety of different mechanisms as would be apparent to a person of ordinary skill in the art). The pedal assembly 805 may include a direct drive (fixed gear) and/or non direct drive e.g., freewheeling configuration. These systems are disclosed in U.S. Pat. Nos. 6,468,185 and 6,793,608, which are hereby incorporated by reference herein in their entirety. A clutching mechanism may also be included which may be preferred where stationary bike 801 is in a fixed gear configuration. U.S. Pat. No. 5,961,424 discloses this feature and is hereby incorporated by reference herein.

The pedal assembly 805 may also be connected to a variable resistance mechanism 807. A variety of different adjustment mechanisms may be used, as would be apparent to a person of ordinary skill in the art, without departing from the scope of the invention, including, but not limited to, a magnetic resistance system, a mechanical brush resistance system, a gearing system, etc. The adjustment mechanism may be activated via a mechanical component of the variable resistance mechanism 807 as illustrated in FIG. 8A and/or via an electronic selection on the stationary bike 801 and/or by selecting a user interface element on the display portion 802.

FIGS. 8A and 8B illustrate the retention system 809A, 809B, which enables the stationary bike 801 to be affixed to a floor and/or a wall so that the stationary bike 801 may become unmovable without access to specialized equipment and/or tools. In one exemplary embodiment, the retention system 809A, may be comprised of bolts that secure the stationary bike 801 to the floor. Bolts are used herein exemplarily, and, as would be apparent to a person of ordinary skill in the art. A variety of different mechanisms and tools may be used to secure and affix the stationary bike 801 to the floor in a manner that the stationary bike 801 cannot be moved or removed without specialized equipment.

As illustrated in FIG. 8B, in accordance with an embodiment of the invention, the retention system 809B may be comprised of a wall mount. The wall mount enables the stationary bike 801 to securely attach and/or affix to a wall (or another structure). In one specific implementation, the wall mount enables the stationary bike 801 to attach to a wall within a corrections facility. Bolts, fasteners, screws, etc. may be used to do so. Indeed, a variety of different mechanisms may be used to connect the stationary bike 801 to a wall, as would be apparent to a person of ordinary skill in the art, including, but not limited to, bolts, fasteners, etc. The term wall is used herein to generally refer to any space or structure that may be disposed in front of and/or near the stationary bike 801, and can include posts, chambers, etc.

FIG. 8C illustrates another exemplary structure to which the exercise bike 801 may be attached to. The structure 814 may be a computing device storage device that may be used to house a number of computing devices 815. The exercise bike 801 may securely attach to the structure 814 via a retention system that is similar to the one described and illustrated in reference to FIG. 8B. The structure may house and/or charge the computing devices 815. A user who wishes to exercise on the exercise bike 801 may remove a computing device 815 from the structure 814 and attach the computing device 815 to the exercise bike 801. The user may then log into his or her account via the user interface components of the computing device to access the features that are described herein in reference to FIGS. 1-3B.

In one embodiment, the stationary bike 801 may also be comprised of sensors (not shown) that may be disposed throughout or within at least a portion of the stationary bike 801. A variety of different sensors may be used to measure of variety of different parameters and generate a variety of performance data based on a user's usage of the smart bike. In other embodiments, the sensors may be worn on a user, which may communicate, wirelessly or via a wired means, with the stationary bike 801 and/or the computing device of the stationary bike 801 such as the display device 802.

In one embodiment, heart rate sensors 813 may be disposed on the handlebar portion 806. While depicted along a top portion of the handlebar portion 806, heart rate sensors 813 may be disposed at different locations along the handlebar portion 806 and may include additional heart rate sensors beyond that depicted such that a user's heart rate can be detected when a user places their hands on different portions of the handlebar portion 806. The heart rate detected by the heart rate sensors 813 may generate an alert to notify other staff if a detected heartrate goes above a threshold to prevent risk of harm to users and to the components themselves. Sensor(s) may be included inside housing 804 in order to protect the sensor(s) from damage and tampering.

In one embodiment, sensors may detect pedal speed and/or estimated effort exerted by a user. A variety of different sensor and/or sensor arrays and computation methodologies may be used, as would be apparent to a person of ordinary skill in the art, without departing from the scope of the invention. For example, in one embodiment, a sensor may measure the rotational velocity of at least a portion of the variable resistance mechanism 807 to determine the speed with which a user may be pedaling. The rotational velocity may be translated into actual speed by using an appropriate algorithm and a computing device in accordance with the description herein. In addition, the sensor or a corresponding computing device may obtain the resistance selection applied by the user, and use the obtained resistance data and the speed data to compute or estimate the effort that may be exerted by the user. In one embodiment, additional information about the user may be obtained from the user's user profile. This information in the user profile, such as, the user's weight, BMI etc. may be used to compute the amount of progress that the user is making towards his or her goals. For example, if a user's goal is to lose five pounds, then the effort exerted data may be used, in conjunction with the user profile data, to compute how much weight the user may have lost based on the session data.

Figure 9:
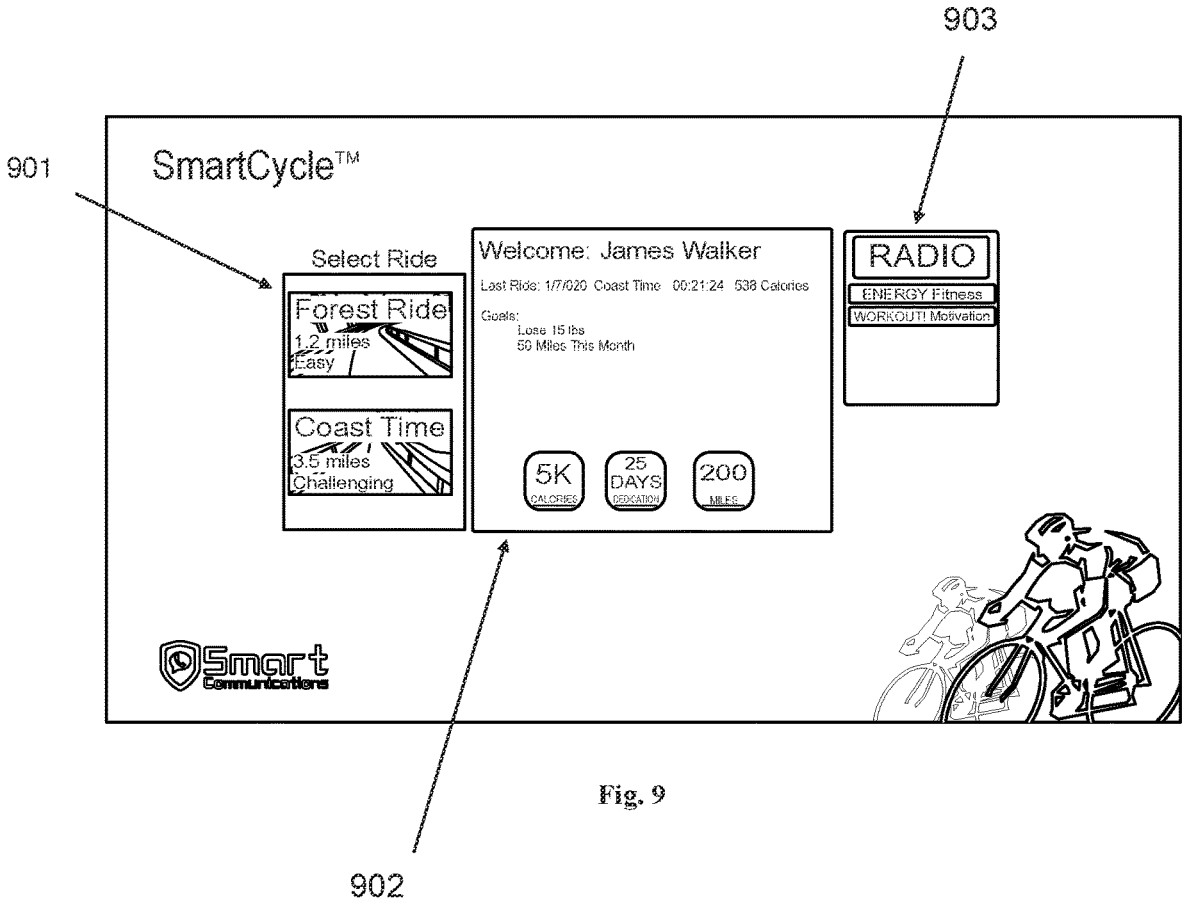
FIG. 9 illustrates an exemplary graphical user interface in accordance with an exemplary embodiment of the present invention.

FIG. 9 illustrates an exemplary user interface associated with an embodiment of the invention. In one embodiment of the invention, the user interface elements described and illustrated in reference to FIGS. 9, 10 and 11 may be displayed within the display device 802 of the stationary bike 801 including a tablet computing device as described in reference to FIG. 8. As illustrated in FIG. 9, the user interface 900 displays a variety of information, including information that is specific to the user (i.e. obtained from the user's user profile), 902, course options information 901, and audio/visual content 903 that the user may want to consume during his or her exercise session. For example, the user interface may illustrate historical user data 902, present exercise modules for selection 901, and audio and/or visual content options 903. In one embodiment a user may use an input device to select one or more of these user interface elements to initiate an exercise session. As illustrated in element 902, the user specific information may comprise a user name, calories burned (during a previous session), distance cycled (during a previous session), exercise duration (during a previous session), number of consecutive days of exercise, and user goals and achievements. Element 901 of the user interface may include at least one exercise module that a user may select for an exercise session. As illustrated in FIG. 9, the various exercise modules may be comprised of virtual course that a user may have to navigate (and wherein hills may be represented by automatically adjusting the resistance). While depicted here as virtual cycling courses, other options comprise virtual classes with live or pre-recorded instructor led sessions and workout routines which may comprise visual commands to adjust resistance and target pedaling speeds throughout the routine. Element 902 of the user interface may display user information, historical user data such as the previous exercise module completed, duration of that exercise module and calories burned. Additional information in element 902 comprises multi-session goals and achievements such as a total number of calories burned over time, number of consecutive days of exercise and total distance pedaled over time. This information may be presented as lifetime, weekly and/or monthly goals and achievements. Element 903 of the user interface displays audio content that a user may select to listen to during an exercise session such as listening to the radio or listening to audio content geared at providing motivation for the exercise session.

Figure 10:
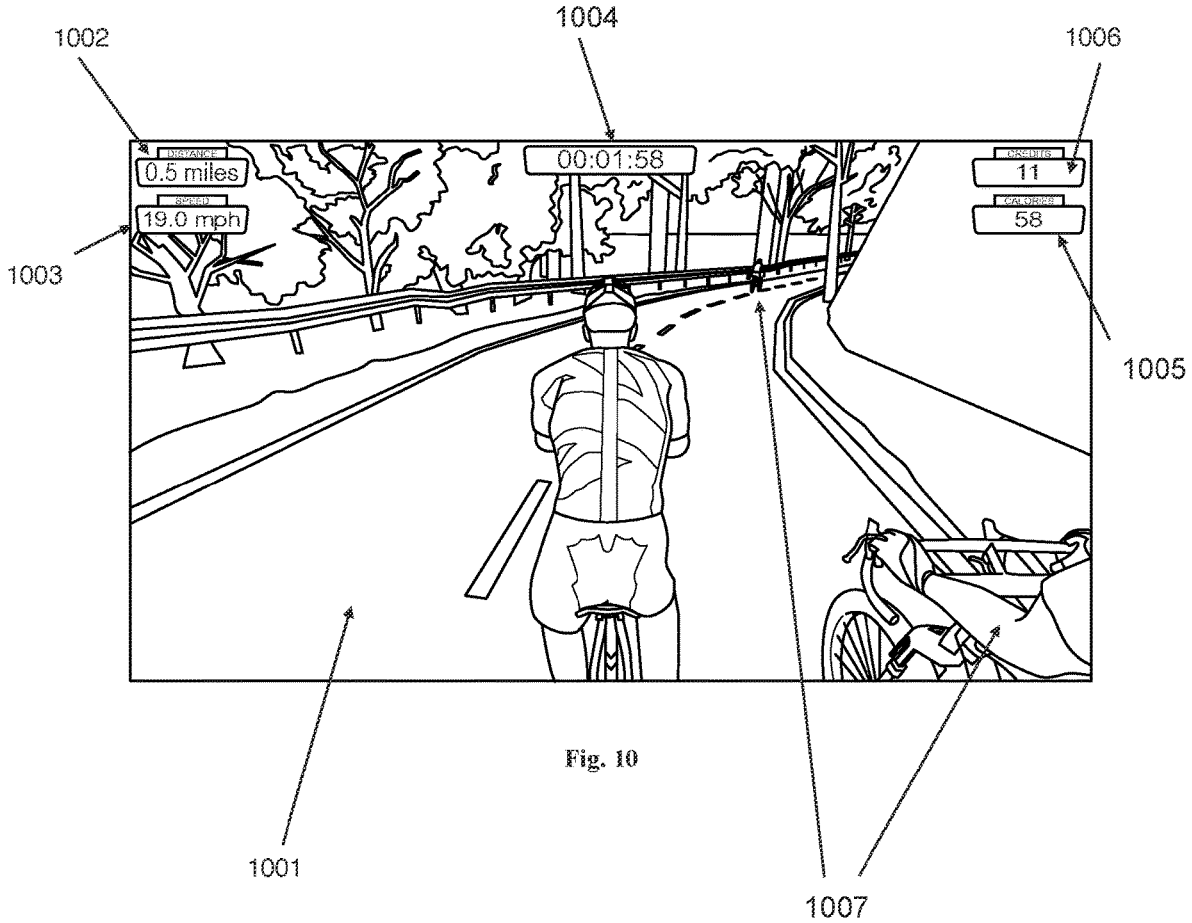
FIG. 10 illustrates an exemplary graphical user interface in accordance with an exemplary embodiment of the present invention.

FIG. 10 shows an exemplary user interface elements that may be displayed to a user when the user is working out on the exercise bike (i.e. after the exercise module has started and before it has ended). These user interface elements may be presented to the user during the user's workout session with the exercise apparatus(es). The user interface elements may show digital content associated with a selected exercise module, such as a virtual cycling course, a live or pre-recorded cycling class, or a cycling workout routine all of which can be displayed in area illustrated by element 1001. It is noted in this example, that the user may be presented with information about their real-time usage data, session data, and/or exercise indicator data. Users may be presented with information such as distance traveled 1002, speed information 1003, such as current, average and max speed, elapsed duration of current exercise session 1004, calories burned 1005, and converted exercise indicators 1006 earned during the exercise session. This may serve to help motivate a user to continue exercising in order to achieve a certain number of exercise indicators, such as points or credits that they need in order to obtain a benefit they are striving for, such as additional use of a communication system. In addition, the user interface allows users to see other users participating in the same exercise module in real time as exemplified by 1007. In order to present this information to a user, the exercise system may be configured to calculate relative user locations and speeds and depict such on each user's display as part of participating in an exercise module. This may involve receiving usage data from a plurality of exercise apparatuses, analyzing the received usage data in real-time to determine real-time speeds and distance traveled of respective users, and adjust in real-time the relative size and location of users within the display area.

Figure 11:
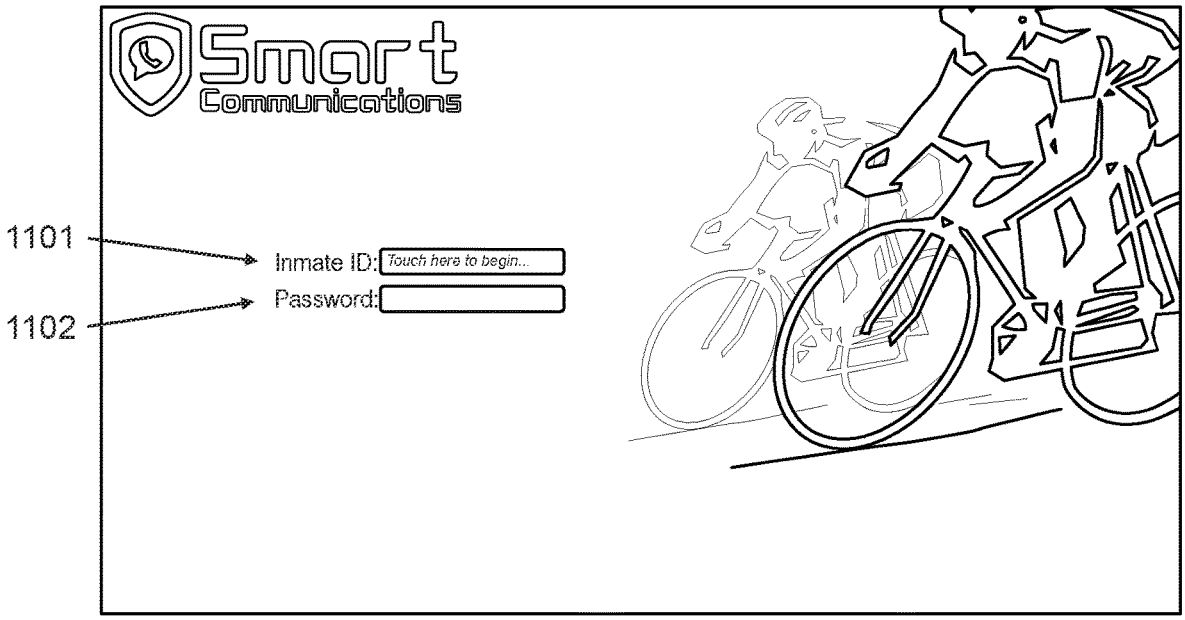
FIG. 11 illustrates an exemplary user interface associated with a security platform in accordance with an embodiment of the present invention.

FIG. 11. illustrates an exemplary user interface associated with aspects of a security platform according to one embodiment of the invention. The user interface displays fields where a user can enter a user identifier at 1101 and password at 1102. The user identifier and password received via these fields can be used by the security platform in order to ensure users (e.g. inmates) only access their own user profile for earning exercise indicators and benefits. In one embodiment, The skilled person will be aware of a range of possible modifications of the various embodiments described above. Accordingly, the present invention is defined by the claims and their equivalents.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and Bis false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

The invention claimed is:

1. A stationary exercise bike for use within a correctional facility, the exercise bike comprising:

a frame portion that is configured to support a user to allow the user to at least one of sit and stand on the stationary exercise bike;

an adjustable seat portion and an adjustable handle portion that are coupled to the frame portion;

a drive mechanism that includes a pedal assembly and a flywheel, wherein the drive mechanism is capable of turning when a user applies force against at least a portion of the pedal assembly;

a display portion that is comprised of a tablet computing device, wherein the display portion is releasably attachable to the frame portion, the display portion electronically communicating with sensor data received from sensors that are connected to the exercise bike, the display portion further capable of displaying exercise modules and performance related data;

a housing comprising a locking system, wherein the housing encloses at least a portion of the frame portion, and wherein the housing cannot be opened unless the locking system is unlocked; and a retention portion for securely attaching at least a portion of the frame portion to at least one of flooring upon which the exercise bike is placed and a wall that may be disposed near the exercise bike.

2. The exercise bike of claim 1, further comprising at least one heart rate sensor that is disposed on the handle portion.

3. The exercise bike of claim 1, wherein the tablet computing device of the display portion is in at least one of wired and wireless communication with at least one sensor.

4. The exercise bike of claim 1, further comprising a resistance adjustment mechanism for the user to adjust the pedaling resistance of the exercise bike.

5. The exercise bike of claim 1, wherein the display portion is configured to display at least one of a user identifier, cadence, resistance, heart rate and effort exerted during an exercise module.

6. The exercise bike of claim 1, wherein the display portion displays a plurality of exercise modules for selection.

7. The exercise bike of claim 6, wherein the display portion displays content of a selected exercise module while an inmate participates in the selected exercise module by causing movement of the pedal assembly.

8. The exercise bike of claim 1, wherein the sensor is comprised of at least one of a voltage sensor, a current sensor, and a heart rate sensor.

9. The exercise bike of claim 1, wherein the display portion receives performance data which is comprised of at least one of: voltage, current, pulses, time information, work, and power.

10. The exercise bike of claim 1, further comprising a computing device that is connected to the exercise bike, wherein the computing device receives sensor data and performance data and computes at least one of: cadence, effort exerted, exercise duration, calories burned, heart rate, and speed information.

11. A stationary exercise bike for use within a correctional facility, the exercise bike comprising:

a frame portion that is configured to support a user to allow the user to at least one of sit and stand on the stationary exercise bike;

an adjustable seat portion and an adjustable handle portion that are coupled to the frame portion;

a drive mechanism that includes a pedal assembly and a flywheel, wherein the drive mechanism is capable of turning when a user applies force against at least a portion of the pedal assembly;

a display portion that is comprised of a tablet computing device, wherein the display portion is releasably attachable to the frame portion, the display portion electronically communicating with sensor data received from sensors that are connected to the exercise bike, the display portion further capable of displaying exercise modules and performance related data;

a housing comprising a locking system, wherein the housing encloses at least a portion of the frame portion, and wherein the housing cannot be opened unless the locking system is unlocked; and a retention portion for securely attaching at least a portion of the frame portion to at least one of flooring upon which the exercise bike is placed and a wall that may be disposed near the exercise bike, wherein the retention portion comprises at least one fastener configured to be coupled with the frame portion and at least one of the flooring and the wall.

* * * * *